US010962319B2

(12) United States Patent
Shneorson et al.

(10) Patent No.: US 10,962,319 B2
(45) Date of Patent: Mar. 30, 2021

(54) ELECTRO MECHANICAL FIRE CONTROL APPARATUS

(71) Applicant: ISRAEL WEAPON INDUSTRIES (I.W.I.), Ramat HaSharon (IL)

(72) Inventors: Zeev Shneorson, Ra'anana (IL); Ariel Paludis, Peduel (IL); Alexander Cooper, Beer Ya'akov (IL); Ron Gur, Zur Moshe (IL); Shachar Ben David, Kokhav Yair (IL); Dotan Lamm, Ramat Hasharon (IL); Aviram Sobol, Netanya (IL); Naor Sagy, Tel Aviv (IL)

(73) Assignee: ISRAEL WEAPON INDUSTRIES (I.W.I) LTD, Ramat Hasharon (IL)

( * ) Notice: Subject to any disclaimer, the term of this patent is extended or adjusted under 35 U.S.C. 154(b) by 0 days.

(21) Appl. No.: 16/926,804

(22) Filed: Jul. 13, 2020

(65) Prior Publication Data

US 2020/0340771 A1 Oct. 29, 2020

Related U.S. Application Data

(62) Division of application No. 16/252,643, filed on Jan. 20, 2019, now Pat. No. 10,845,148.

(30) Foreign Application Priority Data

May 13, 2018 (IL) ..... 259323

(51) Int. Cl.
*F41A 19/59* (2006.01)

(52) U.S. Cl.
CPC ..... *F41A 19/59* (2013.01)

(58) Field of Classification Search
CPC ..... F41A 17/00; F41A 17/06; F41A 17/46; F41A 17/56; F41A 17/64; F41A 17/74; F41A 19/58; F41A 19/59; F41A 19/64
USPC ..... 89/28.1, 129.01, 129.02, 130, 131, 132, 89/135, 136, 142, 144, 148, 149
See application file for complete search history.

(56) References Cited

U.S. PATENT DOCUMENTS 1,342,729 A * 6/1920 Wenner ..... F41A 19/05 89/133
3,703,845 A * 11/1972 Griew ..... F41G 3/26 89/134
3,888,021 A * 6/1975 McCurdy ..... F41A 19/59 434/19
4,563,827 A * 1/1986 Heltzel ..... F41A 17/063 42/70.01

(Continued)

FOREIGN PATENT DOCUMENTS

DE 3446019 A1 * 6/1986 ..... F41A 17/063

*Primary Examiner* — Jonathan C Weber
(74) *Attorney, Agent, or Firm* — Soroker Agmon Nordman

(57) ABSTRACT

A firing control apparatus and method for installing in a firearm, the apparatus comprising: an energy storing mechanism configured to store mechanical energy which is produced by a mechanical system, upon firing the firearm or by manual operation of the firearm, an electromagnet configured to control the energy storing mechanism, wherein the energy storing mechanism holds or releases the mechanical energy to prevent or enable the firearm from firing, and a processor or an electro-mechanical switch configured to activate or deactivate the electromagnet to control the operation of the energy storing mechanism according to preselected rules.

20 Claims, 18 Drawing Sheets

(56) References Cited

U.S. PATENT DOCUMENTS 5,022,175 A * 6/1991 Oncke ..... F41A 17/04 42/66
5,083,392 A * 1/1992 Bookstaber ..... F41A 17/06 42/84
5,704,153 A * 1/1998 Kaminski ..... F41A 17/063 42/117
5,713,150 A * 2/1998 Ealovega ..... F41A 19/46 42/84
5,770,814 A * 6/1998 Ealovega ..... F41A 19/04 89/131
6,976,416 B2 * 12/2005 Ealovega ..... F41A 19/46 89/129.01
7,810,423 B2 * 10/2010 Monroe ..... F41A 5/26 89/193
8,046,948 B2 * 11/2011 Mauch ..... F41A 19/01 42/70.01
8,336,438 B2 * 12/2012 Compton ..... F41A 19/66 89/28.1
8,549,780 B2 * 10/2013 Emde ..... F41A 17/56 42/70.01
8,807,007 B2 * 8/2014 Alicea ..... F41A 19/59 89/28.1
8,966,803 B2 * 3/2015 Dietel ..... F41A 17/08 42/70.08
9,841,249 B1 * 12/2017 Nicks ..... H02J 7/00045
10,240,881 B1 * 3/2019 Galie ..... F41A 19/16
10,378,848 B1 * 8/2019 Galie ..... F41A 19/59
2007/0186457 A1 * 8/2007 Pitt ..... F41A 17/46 42/70.06
2009/0255160 A1 * 10/2009 Summers ..... F41A 17/063 42/70.01
2011/0061280 A1 * 3/2011 Emde ..... F41A 17/066 42/70.06
2011/0259183 A1 * 10/2011 Compton ..... F41A 19/66 89/28.1
2012/0180357 A1 * 7/2012 Dietel ..... F41A 17/08 42/70.06
2013/0118050 A1 * 5/2013 Alicea ..... F41A 19/58 42/84
2015/0345887 A1 * 12/2015 Shneorson ..... F41A 17/08 89/28.1
2016/0377364 A1 * 12/2016 Santos Reis ..... F41A 19/46 89/135

* cited by examiner

200

ELECTRO MECHANICAL FIRE CONTROL APPARATUS

TECHNICAL FIELD

The present disclosure generally relates to an electro mechanical firing control apparatus, and more specifically to an electro mechanical firing control apparatus that enables control of the firing of an automatic or semi-automatic firearm.

BACKGROUND

The automatic firearm was developed over a century ago, and has been in use, in combat, ever since. Modern automatic firing mechanisms are usually mechanical systems that enable a user to switch between firing one round per trigger engagement or multiple rounds consecutively until the trigger is released, based on a simple mode change of the safety lever, as disclosed also in the US patent "AUTOMATIC MACHINE-GUN" U.S. Pat. No. 1,293,021 by J. BROWNING dated 1916. The use of an automatic firing mode, enables firing rounds at a high rate. Most automatic firearm's fire rate range is between 650 to 1200 rounds per minute ("RPM"). The fire rate is mainly affected by the physical characteristics of the mechanical mechanism of the firearm, which relies on the pressure created by the gas emissions originating from the gunpowder combustion process, of each round fired. When a round is fired, some of the gases that are emitted during the combustion of the gunpowder are directed to push a bolt carrier assembly within the firearm, which cocks the hammer of the firearm. In some firearms the possibility of regulating the fire rate can be changed by setting the pressure of the returning gasses. This is usually dune by using a mechanical regulator, enabling only a few different operation modes, as described, for example, in the NEGEV® Light Machine Gun (LMG) manufactured by IWI.

The movement rate of the bolt carrier assembly and hammer, which controls the fire rate in an automatic mode of the firearm, are set by the mechanical mechanism designed by the manufacturer of the firearm. Therefore, the automatic firing rate of a firearm is typically set by the physical characteristics of its mechanical mechanism.

SUMMARY

According to an aspect of some embodiments of the present disclosure there is provided a firing control apparatus for installation in a firearm, comprising: an energy storing mechanism configured to store mechanical energy which is produced by a mechanical system, upon firing the firearm or by manual operation of the firearm, an electromagnet configured to control the energy storing mechanism, wherein the energy storing mechanism holds or releases the mechanical energy to prevent or enable the firearm from firing, and a processor or a simple electro-mechanical switch configured to activate or deactivate the electromagnet to control the movement of the energy storing mechanism according to preselected rules.

According to an aspect of some embodiments of the present disclosure there is provided an Electro Mechanical Fire Control (EMFC) apparatus for controlling firing of a firearm, comprising: a mechanical energy storing mechanism, configured to store mechanical energy which is produced by a mechanical system, upon firing the firearm or by manual operation of the firearm; an electromagnet, configured to control the mechanical energy storing mechanism, wherein the mechanical energy storing mechanism holds or releases the mechanical energy to prevent or enable the firearm from firing; and a processor configured to activate or deactivate the electromagnet to control the operation of the mechanical energy storing mechanism according to preselected rules.

Optionally, the apparatus further comprises at least one sensor configured to provide an indication that the firearm is ready to fire.

Optionally, the apparatus is independent from the mechanical firing mechanism of the firearm, enabling the firearm to be operated normally even if the apparatus malfunctions or runs out of energy.

Optionally, the apparatus's energy storing mechanism is further configured to release or block at least one element, comprising the mechanical firing system of the firearm and participating in the firing process responsible directly or indirectly for firing a round in the firearm.

Optionally, the energy storing mechanism of the apparatus is further configured to release or block at least one element selected from a group consisting of: a sear, a bolt carrier, a slider, a hammer, a trigger and a firing pin Optionally, the apparatus's energy storing mechanism is further configured to be moved to its cocked position by at least one element, comprising the mechanical firing system of the firearm participating directly or indirectly in the cocking process of the firearm, upon firing the firearm or by manual operation of the firearm.

Optionally, the apparatus's mechanical energy storing mechanism is further configured transferred to a cocked position upon firing the firearm or by manual operation of the firearm by at least one element, selected from a group consisting of: a sear, a bolt carrier, a slider, a hammer, a trigger and a firing pin.

Optionally, the apparatus further comprising a movable plate, a magnet and a spring system, wherein said movable plate is connected to the spring system and to the energy storing mechanism, wherein the electromagnet or magnet are configured to attract or repel the movable plate, and wherein the spring system is configured to pull or push the movable plate in an opposite direction, thus controlling the operation of the energy storing mechanism, wherein said electromagnet can produce an electromagnetic field in either direction. For example the electromagnet may be configured to produce an electromagnetic filed in either direction, so it can attract or repel the movable plate.

Optionally, the apparatus's electromagnet and magnet are further configured to overcome the force of the spring system in a storing energy phase, and wherein said spring system is configured to overcome the force of the electromagnet and magnet in a releasing energy phase.

Optionally, the apparatus further comprising a second spring system configured to pull or push the movable plate, preventing the movable plate from encountering the magnet, electromagnet or both with a destructive force.

Optionally, the apparatus further comprising a second spring system configured to pull or push the movable plate in an opposite direction of the fires spring system, preventing the movable plate from encountering the magnet, electromagnet or both with a destructive force.

Optionally, the apparatus further comprises of preselected rules that are selected from the group consisting of: a rule defining number of rounds fired per specific time as long as the trigger is engaged, a rule defining firing up to a preselected number of rounds as long as the trigger is engaged, a rule defining firing a number of rounds with preselected time gaps between them as long as the trigger is engaged, and a rule defining any combination thereof.

Optionally, the apparatus's preselected rules further include firing a first round upon the engagement of the trigger, and firing the following consecutive rounds according to a command from the processor, as long as the trigger is engaged.

Optionally, the apparatus's preselected rules further include firing a first round and the other consecutive rounds according to a command from the processor, as long as the trigger is engaged.

Optionally, when the apparatus's processor is activated the firearm is able to fire only when a safety lever of the firearm is set, mechanically or electronically, to a predefined state.

Optionally, the apparatus's processor sensor is further configured to go into a sleep mode, to save energy, if no indication is received from at least one sensor after a preselected time, and wherein said processor is activated immediately when receiving an indication from at least one sensor.

Optionally, the apparatus further comprises of at least one sensor of a group consisting of: a sensor configured to provide an indication that a trigger of the firearm is engaged, a sensor configured to provide an indication that a round was fired from the firearm, a sensor configured to provide an indication which state is set by the safety lever, a sensor configured to provide an indication which set of predefined rules was chosen, a sensor configured to provide an indication in which state a hammer or a sear of the mechanical firing system is set, a sensor configured to provide an indication in which state a firing pin of the mechanical firing system is set, a sensor configured to provide an indication in which state a bolt carrier assembly of the mechanical firing system is set, a sensor configured to provide an indication if the firearm is being held, a sensor configured to indicate the angle of the firearm, a sensor configured to provide an indication if a processor or another sensor is in sleep mode or not, a sensor configured to provide an indication of the time, a sensor configured to provide an indication of the operation time remaining when using power consumption modes or features, for example electro mechanical fire control apparatus and/or targeting acquisition features, a sensor configured to provide an indication that the system has acquired a target or is locked on a target, a sensor configured to provide an indication of the energy storing mechanism, indicating if the system is cocked or not and a sensor configured to provide an indication of the temperature of an element of the firearm.

Optionally, the apparatus further comprises of a user interface for configuring the processor to operate according to an operation selected from a group consisting of: choosing or reprogramming the preselected rules, enabling and/or disabling the firing mechanism from firing the firearm depending on the pointing vector of the barrel, and locking and/or releasing the firing mechanism by using a code or any other verification method. For example: voice or fingerprint or retina or facial signature/verification.

Optionally, the apparatus further comprises of a communication unit for receiving and transmitting data to configure the processor or to activate the mechanical energy storing mechanism via an external device and to transmit data to an external device.

According to an aspect of some embodiments of the present disclosure there is provided a method for controlling the fire rate of a firearm, the method including: controlling a firing apparatus installed in a firearm, comprising: storing mechanical energy by an energy storing mechanism, said mechanical energy is produced by a mechanical system, when firing the firearm or by manual operation of the firearm, controlling the energy storing mechanism by an electromagnet, wherein the energy storing mechanism holds or releases the mechanical energy to prevent or enable the firearm from firing, and activating or deactivating the electromagnet to control the operation of the energy storing mechanism according to preselected rules.

According to an aspect of some embodiments of the present disclosure there is provided a method of controlling a firing apparatus installed in a firearm, comprising: storing mechanical energy by a mechanical energy storing mechanism, said mechanical energy is produced by a mechanical system, when firing the firearm or by manual operation of the firearm, controlling the mechanical energy storing mechanism by an electromagnet, wherein the mechanical energy storing mechanism holds or releases the mechanical energy to prevent or enable the firearm from firing, and activating or deactivating the electromagnet to control the operation of the mechanical energy storing mechanism according to preselected rules.

Optionally, the method further receives indication that a safety lever is set to a predefined state.

Optionally, the method further displays at least one selected firing rule, at least one sensor status, target status and the amount of remaining power using a user interface or an external display unit via a communication unit.

Optionally, the method further transmits and receives data for configuration of a processor via a wireless or wired communication unit.

According to an aspect of some embodiments of the present disclosure there is provided a fire control apparatus for controlling a firing of a firearm, the fire control apparatus comprising: a movable plate with a first face and a second face substantially facing different directions, wherein the first face of the movable plate is designed to receive mechanical energy from at least one movable mechanical element imparted to the first face of the movable plate during a firing of the firearm or by manual operation of the firearm; a spring with a fixed first end and a second end connected to the movable plate; an electromagnet controllable by a control signal designed to store the received mechanical energy from the firing or from manual operation in the spring by holding the second face of the movable plate in contact with a surface of the electromagnet, and to discharge the stored mechanical energy in the spring into a firing element in contact with the movable plate by releasing the contact of the second face with the surface so as to cause a consecutive firing of the firearm in response to the control signal applied to the electromagnet; and a circuitry, including a processor, configured to generate the control signal in accordance with preselected rules for controlling the consecutive firing of the firearm with the mechanical energy from the previous firing.

According to an aspect of some embodiments of the present disclosure there is provided an electro mechanical fire control apparatus for controlling a firing of a firearm, the electro mechanical fire control apparatus comprising: a mechanical energy storing mechanism comprising: a movable plate with a first face and a second face substantially facing different directions, wherein the first face of the movable plate is designed to receive mechanical energy from at least one movable mechanical element imparted to the first face of the movable plate during a firing of the firearm or by manual operation of the firearm, a spring with a fixed first end and a second end, said spring connected to the movable plate, an electromagnet controllable by a control signal configured to control the mechanical energy storing mechanism to hold or release the mechanical energy in order to prevent or enable the firearm from firing, wherein the mechanical energy storing mechanism (i) stores the mechanical energy received from the firing or from the manual operation, in the spring, by holding the second face of the movable plate in contact with a surface of the electromagnet, and (ii) discharges the stored mechanical energy in the spring into a firing element in contact with the movable plate by releasing the contact of the second face with the surface of the electromagnet so as to cause a consecutive firing of the firearm in response to the control signal applied to the electromagnet; and a circuitry, including a processor, configured to generate the control signal in accordance with preselected rules for controlling the consecutive firing of the firearm with the mechanical energy from the previous firing or from manual operation of the firearm Optionally, the structure of the electromagnet further comprises a magnet.

Optionally, the second face of the movable plate has magnetic or paramagnetic characteristics.

Optionally, the apparatus further comprises a second spring system, attached to the movable plate, which is configured to prevent the second face of the movable plate from damaging the surface of the electromagnet or the surface of the magnet. For example, the second spring system, attached to the movable plate, may be configured to prevent the second face of the movable plate from damaging the structure of the electromagnet. The structure of the electromagnet may further comprise a magnet.

Optionally, the apparatus's preselected rules are selected from the group consisting of: a rule defining number of rounds fired per specific time as long as the trigger is engaged, a rule defining firing up to a preselected number of rounds as long as the trigger is engaged, a rule defining firing a number of rounds with preselected time gaps between them as long as the trigger is engaged, or a rule defining any combination thereof.

Optionally, the apparatus further comprising at least one sensor selected from a group consisting of: a sensor configured to provide an indication that a trigger of the firearm is engaged, a sensor configured to provide an indication that a round was fired from the firearm, a sensor configured to provide an indication which state is set by the safety lever, a sensor configured to provide an indication which set of predefined rules was chosen, a sensor configured to provide an indication in which state a hammer or a sear of the mechanical firing system is set, a sensor configured to provide an indication in which state a firing pin of the mechanical firing system is set, a sensor configured to provide an indication in which state a bolt carrier assembly of the mechanical firing system is set, a sensor configured to provide an indication in which state an element of the mechanical firing system is set, a sensor configured to provide an indication if the firearm is being held or mounted or docked, a sensor configured to indicate the angle of the firearm, a sensor configured to provide an indication if a processor or another sensor is in sleep mode, a sensor configured to provide an indication of the time, a sensor configured to provide an indication of the operation time remaining when using power consumption modes or features, a sensor configured to provide an indication that the system has acquired a target or is locked on a target, a sensor configured to provide an indication of the energy storing mechanism, indicating if the system is cocked or not, and a sensor configured to provide an indication of the temperature of an element of the firearm.

Optionally, the apparatus's movable plate is a bar or a cylinder.

Optionally, the apparatus further comprises a bar, and wherein the first face of the movable plate is coupled to a second end of the bar, and wherein a first end of the bar is designed to receive the mechanical energy from the at least one movable mechanical element which is imparted to the first end of the movable plate during the firing of the firearm, and wherein the second end of the spring is connected to the bar.

Optionally, the apparatus further comprises a bar with a first end and a second end, wherein the first face of the movable plate is coupled to the second end of the bar, and wherein the first end of the bar is designed to receive the mechanical energy from the at least one movable mechanical element which is imparted to the first end of the movable plate during the firing of the firearm, and wherein the second end of the spring is connected to the bar.

Optionally, the apparatus's electromagnet and magnet are configured to overcome the force of the spring in a storing energy phase, and wherein said spring is configured to overcome the force of the electromagnet and magnet in a releasing energy phase.

Optionally, the apparatus's first end of the spring is fixed to an element of the firearm.

Optionally, the apparatus is independent from the mechanical firing mechanism of the firearm, enabling the firearm to be used normally even if the apparatus malfunctions or runs out of energy.

Optionally, the apparatus is independent from the mechanical firing mechanism of the firearm, when the apparatus malfunctions or runs out of energy, the firearm is able to fire a single round with every engagement of a trigger when a safety lever is set to an EMFC firing mode or to a single firing mode, or to fire multiple consecutive rounds when the safety lever is set to automatic firing mode.

Optionally, the apparatus's processor is configured to cause the firearm to fire only when a safety lever of the firearm is set, mechanically or electronically, to a predefined state.

Optionally, the apparatus's processor is configured to go into a sleep mode, to save energy, if no indication is received from at least one sensor after a preselected time, and wherein said processor is activated immediately when receiving an indication from at least one sensor.

Optionally, the apparatus further comprises a user interface for configuring the processor to operate according to an operation selected from a group consisting of: choosing or reprogramming the preselected rules, enabling or disabling the firing mechanism from firing the firearm depending on the pointing vector of the barrel, and locking and releasing the firing mechanism by using a code or any other verification method. For example: voice or fingerprint or retina or facial signature/verification.

Optionally, the apparatus's preselected rules further comprise firing a first round upon engagement of a trigger, and firing the following consecutive rounds according to a command from the processor, as long as the trigger is engaged.

Optionally, the apparatus's preselected rules further comprise firing a first round and the other consecutive rounds according to a command from the processor, as long as a trigger is engaged.

According to an aspect of some embodiments of the present disclosure there is provided a method for controlling a fire control apparatus installed in a firearm, comprising: receiving, on a movable plate with a first face and a second face substantially facing different directions, mechanical energy from at least one movable mechanical element imparted to the first face of the movable plate during a firing of the firearm or by manual operation of the firearm, storing, with an electromagnet controllable by a control signal, the received mechanical energy from the firing or from manual operation in a spring by holding the second face of the movable plate in contact with a surface of the electromagnet, discharging the stored mechanical energy in the spring into a firing element in contact with the movable plate by releasing the contact of the second face with the surface of the electromagnet so as to cause a consecutive firing of the firearm in response to the control signal applied to the electromagnet, and generating using circuitry, the control signal in accordance with preselected rules for controlling the consecutive firing of the firearm with the mechanical energy from the previous firing or manual operation of the firearm.

According to an aspect of some embodiments of the present disclosure there is provided a method for controlling a fire control apparatus installed in a firearm, comprising: receiving, via a movable plate with a first face and a second face substantially facing different directions, mechanical energy from at least one movable mechanical element imparted to the first face of the movable plate during a firing of the firearm or by manual operation of the firearm; storing, with an electromagnet controllable by a control signal, the received mechanical energy from the firing or manual operation in a spring by holding the second face of the movable plate in contact with a surface of the electromagnet, discharging the mechanical energy stored in the spring into a firing element in contact with the movable plate by releasing the contact between the second face and the surface of the electromagnet so as to cause a consecutive firing of the firearm in response to the control signal applied to the electromagnet, and generating using circuitry, the control signal in accordance with preselected rules for controlling the consecutive firing of the firearm with the mechanical energy from a previous firing or manual operation of the firearm.

Optionally, the structure of the electromagnet, further comprises a magnet.

Optionally, the method further displaying a selected firing rule, at least one sensor, target status and the amount of power remaining in a power supply using a user interface or an external display unit communicating with the circuitry via a communication unit.

Optionally, the method further comprising transmitting and receiving data for configuration of the preselected rules via a communication unit.

According to an aspect of some embodiments of the present disclosure there is provided an electro mechanical fire control apparatus for controlling a firing of a firearm, the electro mechanical fire control apparatus comprising: a Force Dividing (FD) system comprising: at least one FD lever comprising at least a first arm and at least a second arm, said at least first arm being longer than said at least second arm wherein said at least one FD lever is configured to pivot around a first mounting point located along the at least first arm to create a fulcrum, wherein the at least one FD lever is designed to receive mechanical energy from at least one movable mechanical element during a firing of the firearm or by manual operation of the firearm, a mechanical energy storing mechanism comprising: a movable plate with a first face and a second face substantially facing different directions, wherein the first face of the movable plate is designed to receive mechanical energy imparted by the at least one FD lever, and a spring with a fixed first end and a second end, said spring connected to the at least one FD lever, an electromagnet controllable by a control signal configured to control the energy storing mechanism to hold or release the mechanical energy such to prevent or enable the firearm from firing, wherein a holding force holds the second face of the moveable plate in contact with a surface of the electromagnet, and a circuitry, including a processor, configured to generate the control signal in accordance with preselected rules for controlling the consecutive firing of the firearm with mechanical energy from a previous firing or from manual operation of the firearm wherein the mechanical energy storing mechanism and the Force Dividing system are configured to: (i) store the received mechanical energy by the spring, (ii) reduce the force applied by the spring onto the moveable plate against the holding force, by dividing the force applied by the spring by a ratio between a length of the at least first arm and a length of the at least second arm, (iii) discharge the mechanical energy stored by the spring onto a firing element in contact with the at least one FD lever by releasing the contact between the second face and the surface of the electromagnet so as to cause a consecutive firing of the firearm in response to the control signal applied to the electromagnet.

Optionally, the structure of the electromagnet further comprises a magnet.

Optionally, the electromagnet and the magnet are further configured to overcome the reduced force applied by the spring in a storing energy phase, and wherein said spring is configured to overcome the holding force of the electromagnet and magnet in a releasing energy phase.

Optionally, the apparatus further comprises a rod connected to the first face of the movable plate, and a second spring with a fixed first end and a second end connected to the rod, wherein the rod is designed to receive mechanical energy from the FD lever.

Optionally, the apparatus further comprises a bar, wherein the bar is designed to (i) receive mechanical energy from at least one movable mechanical element, imparted to the bar during a firing of the firearm or by manual operation of the firearm and (ii) discharge the stored mechanical energy in the spring onto a firing element in contact with the bar, and wherein the second spring is designed to synchronize movement of the rod with movement of the bar.

Optionally, the at least one FD lever of the electro mechanical fire control apparatus further comprises a slot, wherein the at least one pivoting point and the slot are located at different ends of the at least first arm of the FD lever.

Optionally, the at least one FD lever of the electro mechanical fire control apparatus is further configured to pivot around an external pivoting point, located on an external pivoting axis, to create a fulcrum.

Optionally, the at least one FD lever of the electro mechanical fire control apparatus is further configured to pivotally mount on an element of the electro mechanical fire control apparatus or on an element of the firearm.

Optionally, the FD lever of the electro mechanical fire control apparatus is further configured to mount on a mounting point on the first end of the movable plate, further wherein the FD lever slides along the slot and rotates around the mounting point.

Optionally, the FD lever of the electro mechanical fire control apparatus may be a piston or a spring.

BRIEF DESCRIPTION OF THE DRAWINGS

Some non-limiting exemplary embodiments or features of the disclosed subject matter are illustrated in the following drawings.

In the drawings.

Figure 1:
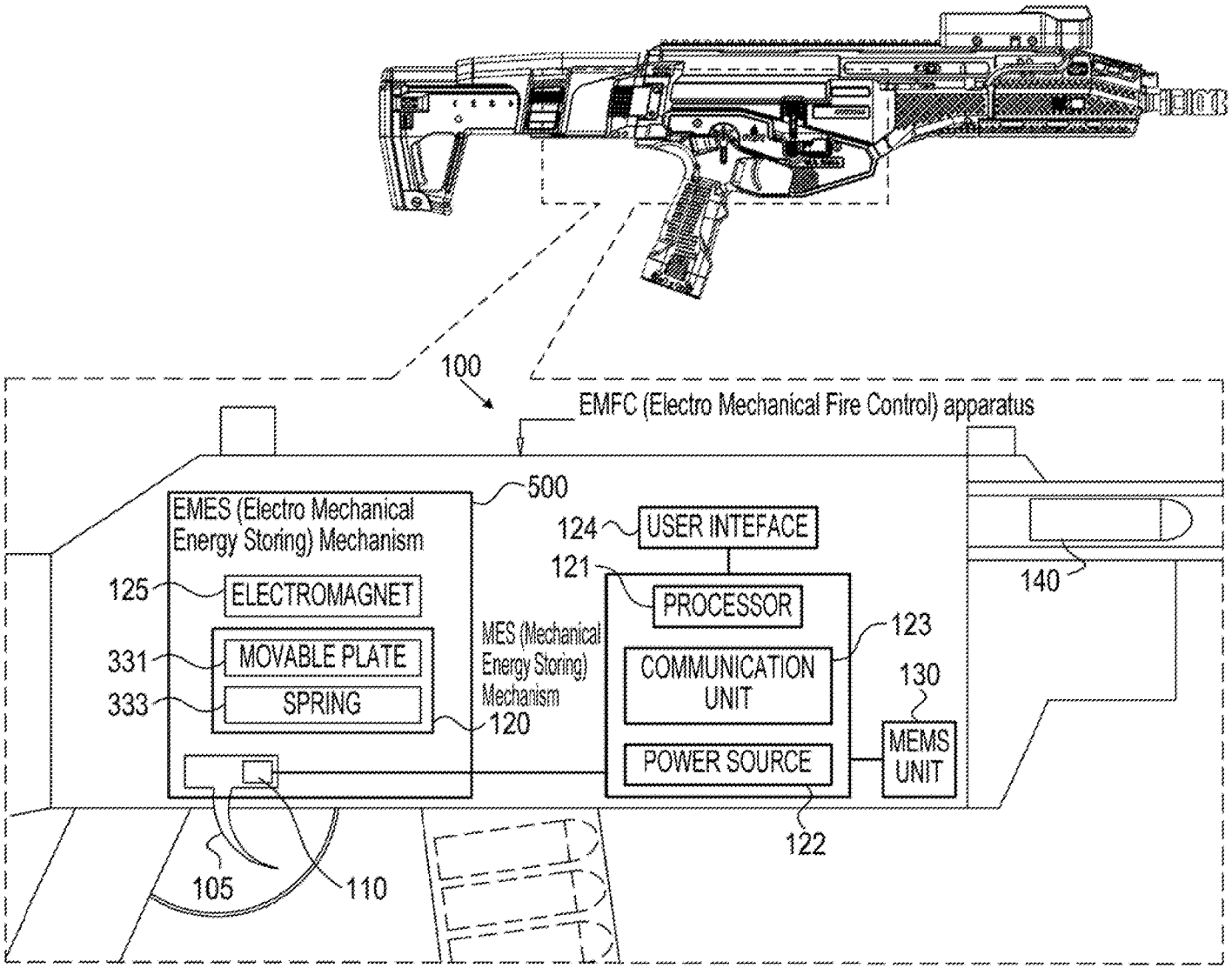
FIG. 1 is a schematic illustration of an Electro Mechanical Fire Control (EMFC) apparatus and its suggested location in a firearm, according to some embodiments of the present disclosure.

With specific reference now to the drawings in detail, it is stressed that the particulars shown are by way of example and for purposes of illustrative discussion of embodiments of the disclosure. In this regard, the description taken with the drawings makes apparent to those skilled in the art how embodiments of the disclosure may be practiced.

Identical or duplicate or equivalent or similar structures, elements, or parts that appear in one or more drawings are generally labeled with the same reference numeral, optionally with an additional letter or letters to distinguish between similar entities or variants of entities, and may not be repeatedly labeled and/or described. References to previously presented elements are implied without necessarily further citing the drawing or description in which they appear.

Dimensions of components and features shown in the figures are chosen for convenience or clarity of presentation and are not necessarily shown to scale or true perspective. For convenience or clarity, some elements or structures are not shown or shown only partially and/or with different perspective or from different point of views.

DETAILED DESCRIPTION

Some embodiments of the present disclosure provide a user of an automatic or semi-automatic firearm with the ability to control the fire rate and/or the number of rounds fired while using the firearm. A user of an automatic or semi-automatic firearm, i.e. a shooter, may be for example a human shooting the firearm, an automatic mechanism for example a robot and/or a remote controlled device. As mentioned above, some known systems provide a user, using the mechanical mechanism of an automatic or semi-automatic firearm, with the ability to fire rounds at a high rate, such high rates may sometimes reach up to 1200 Rounds Per Minute (RPM). At such high rates, the recoil effect of the firearm may impact the ability of the user to steadily hold the firearm, resulting in a decreased stability of the shooter. As a result, the shooter may easily be deviated from the aimed target and the accuracy of the shooting may decrease. Combined with the automatic firing recoil effect at high rate, the reduction of the shooter's stability may also have an effect on their ability to properly realign the firearm with the designated target. The difficulty to realign the firearm may result in the reduction of accuracy when firing more than one round at a time, and of the overall effectiveness of the shooter, for example in combat situations, where the time it takes to realign the firearm and/or aim is critical.

According to some embodiments of the present disclosure, the apparatus disclosed may reduce the fire rate of a firearm according to the user's requirements, which may vary from one user to another. For example, one user might use a bipod when firing the firearm and therefore may set the apparatus to fire rounds at a rate of 800 RPM, while another user may mainly use the firearm while standing, and therefore may wish to set the fire rate to 300 RPM. The apparatus may enable switching between RPM modes according to the user's requirements on site and according to a specific situation, without the need for a professional assistance and/or hard-to-get equipment.

As mentioned above, in known systems, a firearms' RPM is defined and/or set as a result of the firearms design and/or manufacturing process. Since the RPM is a direct result of the firearms mechanical structure, changing the firearms design and/or manufacturing process might affect the firearms overall performance. For example, using a less powerful spring to push back the bolt carrier assembly/slider, may reduce the overall RMP but may also cause the firearm to malfunction more frequently and/or easily. As disclosed above other known solutions for controlling firing rate, may regulate the amount of gases used to push back the bolt carrier assembly or slider. These solutions may be limited to a few predesigned gas operated firearms and may not be accurate or be an easy to apply solution. Furthermore, changing the amount of gases used for pushing back the bolt carrier assembly/slider may arise the same problems as mentioned when changing the mechanical structure of the firearm. However, according to some embodiments of the present disclosure, the apparatus disclosed may solve the presented problem by reducing the fire rate of a firearm without affecting other performance and/or operation aspects of the firearm. Furthermore, the apparatus may be compatible with a variety of firearms and is not limited to one design or operation principle. For example, the apparatus may be placed vertically, horizontally and/or at any other required position, depending on the structure and/or operation aspects of the intended firearm.

According to some embodiments of the present disclosure, the apparatus disclosed may also resolve some of the maintenance challenges, such as deterioration of the firearm due to mechanical strain. The firing rate of the firearm may cause fast and powerful contact between components of the firearm, which may cause them to wear out faster. Therefore, reducing the firearm's fire rate may help prolong the firearm's lifetime. Furthermore, the intense friction of the different components may cause them to heat fast, which may result in the reduction of the effective performance of the firearm and the need of increased maintenance. The control and/or reduction of the fire rate may help reduce the rapid heating and maintain the firearm. For example the overheating of the barrel which may cause it to deform. Furthermore, the use of the apparatus may help the user and/or maintenance professional to know and/or asses the firearms operational status. Knowing the firearms operational status may help prioritize maintenance requirements and therefore may result in saving money and/or time.

Therefore, some embodiments of the present disclosure solve the problems caused by an excessive firing rate, as described above, by enabling easy control of the firing rate of a firearm, e.g., the rate at which the rounds are fired from the firearm. For example, the firing rate apparatus may electromechanically control at least one mechanical element participating in the firing process such as, a trigger, a sear, a bolt carrier assembly, a slider, a hammer and/or firing pin, for example by using an electromagnet or an equivalent electronically controlled actuator.

Some embodiments of the present disclosure may include a system, a method, and/or a computer program product. The computer program product may include a tangible non-transitory computer readable storage medium (or media) having computer readable program instructions thereon for causing a processor to carry out aspects of the present disclosure. Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including any object oriented programming language and/or conventional procedural programming languages.

Before explaining at least one embodiment of the disclosure in detail, it is to be understood that the disclosure is not necessarily limited in its application to the details of construction and the arrangement of the components and/or methods set forth in the following description and/or illustrated in the drawings and/or the Examples. The disclosure is capable of other embodiments or of being practiced or carried out in various ways.

Reference is now made to FIG. 1, which is a schematic illustration of Electro Mechanical Fire Control (EMFC) apparatus 100 and its suggested location in a firearm, according to some embodiments of the present disclosure. EMFC 100 may be located inside a firearm, and may be integrated with its mechanical firing mechanism. According to FIG. 1, EMFC apparatus 100 may comprise several elements. For example, Mechanical Energy Storing (MES) mechanism 120, which may comprise among other things, spring 333, movable plate 331 and optionally a magnet (e.g., magnet 332 as detailed with respect to FIGS. 3A-3C). MES mechanism 120 may use spring 333 to store some of the mechanical energy generated upon firing of the firearm or by manual operation of the firearm. Storing and/or releasing some of the mechanical energy in MES mechanism 120 may be controlled by the activation and/or deactivation of electromagnet 125. For example, upon activation, electromagnet 125 may generate a magnetic field and/or force which may cause MES mechanism 120 to release and/or store mechanical energy, as detailed below. Electromagnet 125 combined with MES mechanism 120 may form an Electro Mechanical Energy Storing (EMES) mechanism 500, which may be controlled by processor 121. For example, processor 121 using power source 122, may control the operation of EMES mechanism 500 by activating and/or deactivating electromagnet 125, thereby enabling EMES mechanism 500 to release and/or store mechanical energy. Releasing the mechanical energy stored in EMFC apparatus 100 may enable the mechanical firing system of the firearm to fire a round.

EMFC apparatus 100 may not operate and/or enable the mechanical firing system of the firearm to fire unless set to a predefined mode. Switching the safety lever (shown in FIG. 2 as safety lever 230) to a predefined mode may activate EMFC 100. For example, to activate EMFC 100, a user may set the safety lever to an automatic mode, semi-automatic mode and/or any other predefined operation mode. EMFC 100 may comprise various sensors, for example trigger sensor 110, which may generate notification regarding the engagement and/or disengagement of trigger 105. For example, if a user engages trigger 105 and/or disengages it, sensor 110 may generate and/or send certain indication to processor 121. Upon receiving indication from sensor 110, processor 121 may activate and/or deactivate electromagnet 125, using the power supplied by power source 122. Processor 121 may use a circuitry to generate a signal to control electromagnet 125. For example, the circuitry may convert the digital output of the processor to an analog signal, thus enabling processor 121 to control the currents in electromagnet 125. By controlling the currents in electromagnet 125, processor 121 may activate or deactivate the magnetic field generated, control its force and direction. Activating and/or deactivating electromagnet 125 may result in firing round 140 and/or stopping the mechanical firing mechanism from firing another round. Power source 122 may be responsible for the power supply required for operating EMFC 100. When not in use, processor 121 may go into a sleep mode in order to save power. When power source 122 runs out and/or is low, it may be replaceable in a quick and easy manner whiteout the need of a professional assistance and/or hard-to-get tools, suitable, for example for combat situations. The replacement of power source 122 may be for example, by another disposable and/or rechargeable power source, such as a battery, power cell, and/or an external power source such as an electrical cable. Alternatively, the power required for operating EMFC 100 may be derived from the mechanical operation of the firearm utilizing the energy generated by firing and/or by manual operation. It should be noted that the firearm is fully capable of operating in a semi-automatic and/or an automatic mode even without EMFC 100. For example if the apparatus malfunctions and/or power source 122 runs out of power. However, in that situation the user may not be able to automatically control the fire rate of the firearm using EMFC 100.

Processor 121 may use communication unit 123 to receive and/or send data to an external device, for example a smartphone, tablet and/or other computerized devices. For example, processor 121 may receive instructions, for example according to reprogramming the preselected rules or according to choosing the predetermined rules stored in a non-transitory memory readable by the processor. For example, the predetermined rules include at least one of firing preselected number of rounds per specific time, as long as the trigger is engaged; firing up to a preselected number of rounds, as long as the trigger is engaged; firing a number of rounds with preselected time gaps between them, as long as the trigger is engaged; First Hit (FH)—firing a first round upon the engagement of the trigger and according to a command from the processor, and the other consecutive rounds according to a command from the processor, as long as the trigger is engaged and/or Two Hit (TH)—firing a first round upon the engagement of the trigger, and firing the following consecutive rounds according to a command from the processor, as long as the trigger is engaged or a combination thereof. Processor 121 may also use communication unit 123 to send feedback regarding the operation conditions of the firearm, for example via Wi-Fi, Bluetooth, NFC, cable or any other means and/or methods for transferring and/or communicating data. For example, during a maintenance inspection, processor 121 may send to the maintenance professionals' computerized device indication regarding the firearms status. For example, the number of rounds fired since the last inspection, the number of rounds fired since the firearm was manufactured, the number of malfunctions that occurred during a specific time period, the sequence of firing/operations prior to a malfunction and/or other information that might be relevant for the maintenance inspector. It should be noted that using communication unit 123 may enable a remote access to the firearm firing system. For example, a user may instruct processor 121, via communication unit 123, to fire the firearm via remote access, even without the engagement of trigger 105.

Processor 121 may use user interface 124 to display relevant and/or important information to the user in real time. For example, processor 121 may present the amount and/or percentage of remaining power in power source 122, how many rounds were fired or are left, target status and/or present the preselected rules available and/or the chosen preselected rule and/or enable the user to reprogram the preselected rules. User interface 124 may also enable a user to input instructions into processor 121. For example, a user may use interface 124 to instruct processor 121 to lock and/or release the firearm by using a code, for example, face recognition, eye/retina and/or fingerprint identification, numerical and/or a sequence code, other mechanical or electronic locking features and/or a combination thereof. A user may also change the fire rate by selecting a new preselected rule and/or by manually adjusting the required fire rate. For example, a user may adjust the number of rounds fired per a single pull of the trigger and/or switch between different preselected rules as indicated above, such as FH or TH.

By integrating EMFC apparatus 100 to a mechanical firing mechanism of a firearm, a user may be able to control and/or reduce the firing rate of the firearm. Processor 121 may activate and/or deactivate electromagnet 125 or an equivalent electronically controlled actuator, to attract and/or repel movable plate 331, to cock and/or release a movable mechanical element participating in the firing process of the firearm, such as a trigger, a sear, a bolt carrier, a bolt carrier assembly, a hammer, a slider and/or a firing pin, as described later on, to match the required fire rate of the firearm. In some embodiments Electro Mechanical Energy Storing (EMES) mechanism 500 is configured to release and/or block at least one element, comprising the mechanical firing system of the firearm and participating in the firing process responsible directly or indirectly for firing a round in the firearm. For example, a trigger, a sear, a bolt carrier, a bolt carrier assembly, a hammer, a slider and/or a firing pin, as described later on, to match the required fire rate of the firearm. In some embodiments EMES 500 may be moved to a cocked position by at least one element, comprising the mechanical firing system of the firearm participating directly or indirectly in the cocking process of the firearm, upon firing the firearm or by manual operation for the firearm. For example, a trigger, a sear, a bolt carrier, a bolt carrier assembly, a hammer, a slider and/or a firing pin, as described later on, to match the required fire rate of the firearm.

According to some embodiments of the present disclosure, EMFC apparatus 100 may comprise a known Micro Electro Mechanical system ("MEMs") unit 130, which may enable EMFC apparatus 100 to determine whether the firearm has deviated from its firing angle and/or direction, using for example a gyro and/or a sensor which may be configured to provide an indication in which angle and/or direction the firearm is positioned. Upon the received indication from MEMs 130, processor 121 may determine, for example that firearm 200 has deviated from its original and/or selected firing angle and/or direction more than a predetermined range. Processor 121 may then, for example prevent further firing of the firearm until trigger 105 is disengaged and/or the firearm is realigned with its original and/or acquired angle and/or direction.

Processor 121 may further be configured, for example by using interface 124 and/or communication unit 123, to enable firing only within predetermined boundaries. For example, a user may configure processor 121 to lock the firearm's firing mechanism when the direction of the barrel may be classified as an unsafe direction and/or deviation angle. For example, enabling the firing mechanism to fire within predetermined borderlines such as in a shooting range. Processor 121 may further disable the firing mechanism from firing, for example, when MEMs unit 130 detects that the direction, that the barrel of the firearm is pointed at, exceeds predetermined borderlines, which may be part of the preselected rules. It should be noted that the borderlines may vary from any of at least two points of an entire sphere, e.g. 360° vertical and 360° horizontal.

It should be noted that there may be more sensors configured to sending indications to processor 121 regarding the firearms status, than illustrated in the figures. For example: a sensor which is configured to provide an indication that a round was fired from the firearm; a sensor which is configured to provide an indication which mode is set and/or selected by the safety lever; a sensor which is configured to provide an indication which set of predefined rules were chosen; sensors which are configured to provide an indication in which state a hammer, a disconnector and/or a sear of the mechanical firing system are in; a sensor which is configured to provide an indication in which state a firing pin of the mechanical firing system is in; a sensor which is configured to provide an indication in which state a bolt carrier assembly of the mechanical firing system is in; a sensor which is configured to provide an indication if someone is physically holding the firearm i.e. if the firearm is being held or mounted or docked; a sensor which is configured to indicated the angle of the firearm i.e. provide an indication in what angle the firearm is positioned; a sensor which is configured to provide an indication if the firearm, a processor and/or another sensor is in sleep mode or not; a sensor which is configured to provide an indication of the time; a sensor which is configured to provide an indication of the remaining operation time, when using power consumption modes or features; a sensor which is configured to provide an indication that the system has acquired a target or still locked on a target, for example a target status; a sensor which is configured to provide an indication of the energy storing mechanism, and/or a sensor which is configured to provide an indication if the system is cocked or not; and a sensor configured to provide an indication of the temperature of an element of the firearm, for example a sensor configured to provide an indication of the temperature of the barrel of the firearm.

Figure 2:
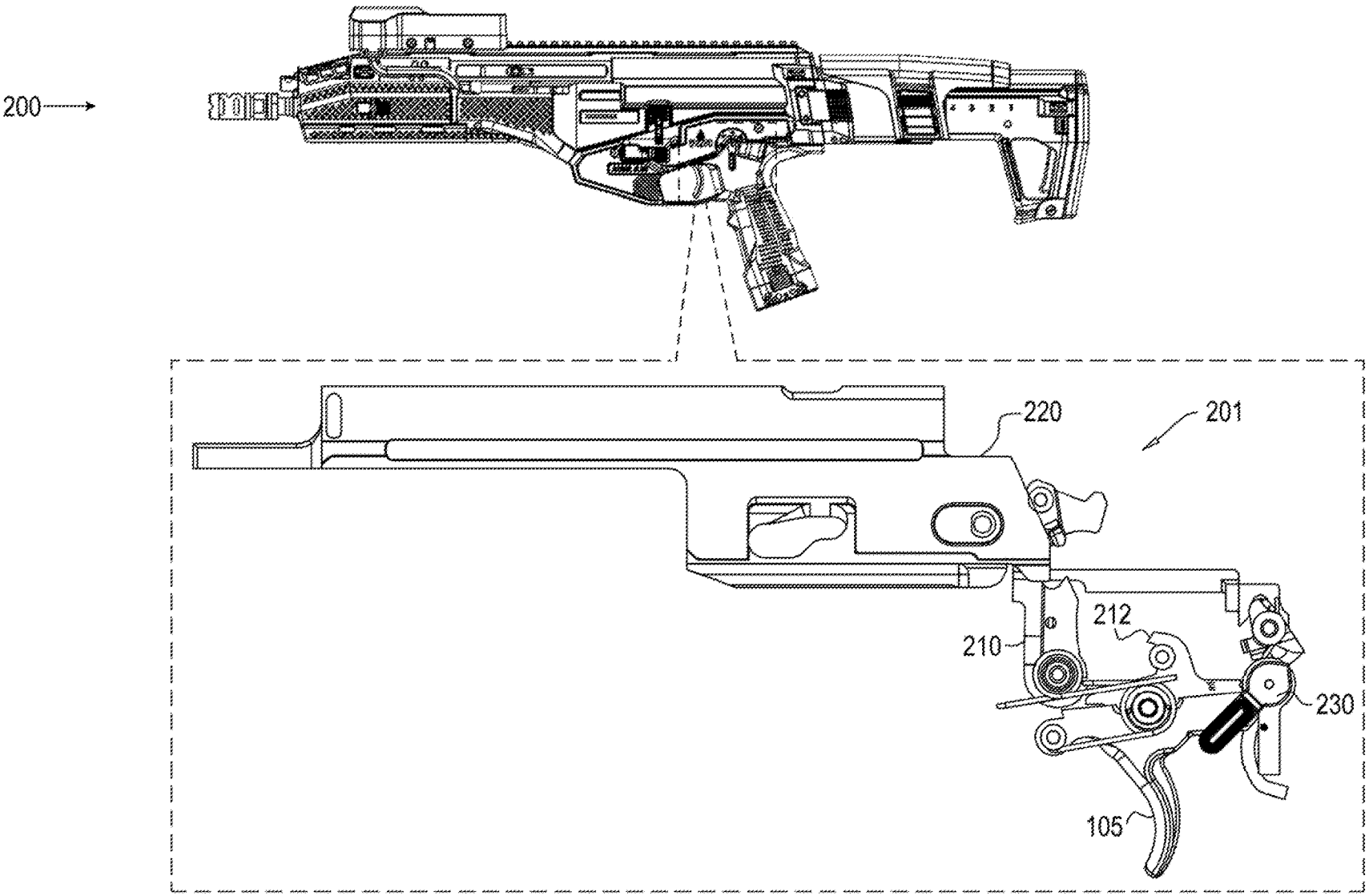
FIG. 2 is a schematic illustration of a side-view of a mechanical firing mechanism and its suggested location in a firearm, according to some embodiments of the present disclosure.

Reference is now made to FIG. 2, which is a schematic illustration of a side view of mechanical firing mechanism 201 and its suggested location in a firearm, according to some embodiments of the present disclosure. FIG. 2 illustrates a mechanical mechanism of a firearm after a round was fired, illustrating that hammer 210 engages bolt carrier assembly 220, specifically, hammer 210 engages the firing pin (not shown), according to some embodiments of the present disclosure. As illustrated in FIG. 2, mechanical firing mechanism 201 is composed of trigger 105, disconnector 212, hammer 210, bolt carrier assembly 220, safety lever 230, and sets of springs which are not depicted herein. When trigger 105 is engaged, it may move disconnector 212, which in turn may release hammer 210 from its locking position. Hammer 210 may then be pivoted by a spring system, for example in a rotating motion, which may cause it to strike a firing pin (not shown), which may be placed for example in bolt carrier assembly 220. The firing pin may then strike round 140, resulting in the firing of firearm 200. As a result, the gases emitted during the firing of round 140 may push bolt carrier assembly 220, causing it to slide along a rail (not shown) toward the rear of the firearm. When pushed toward the rear of firearm 200, bolt carrier assembly 220 may for example pull, along with its sliding motion, hammer 210. Hammer 210 when pulled back, for example in a rotating motion, may be locked in by disconnector 212 in a cocked position. In order for firearm 200 to fire, safety lever 230 may first, for example be moved from a safety mode (not shown) to a firing mode (not shown). Moving safety lever from the safety mode may enable firearm 200 to fire. For example, safety lever may be moved to a semi-automatic, an EMFC and/or fully automatic modes of firing operation.

Figure 3A:
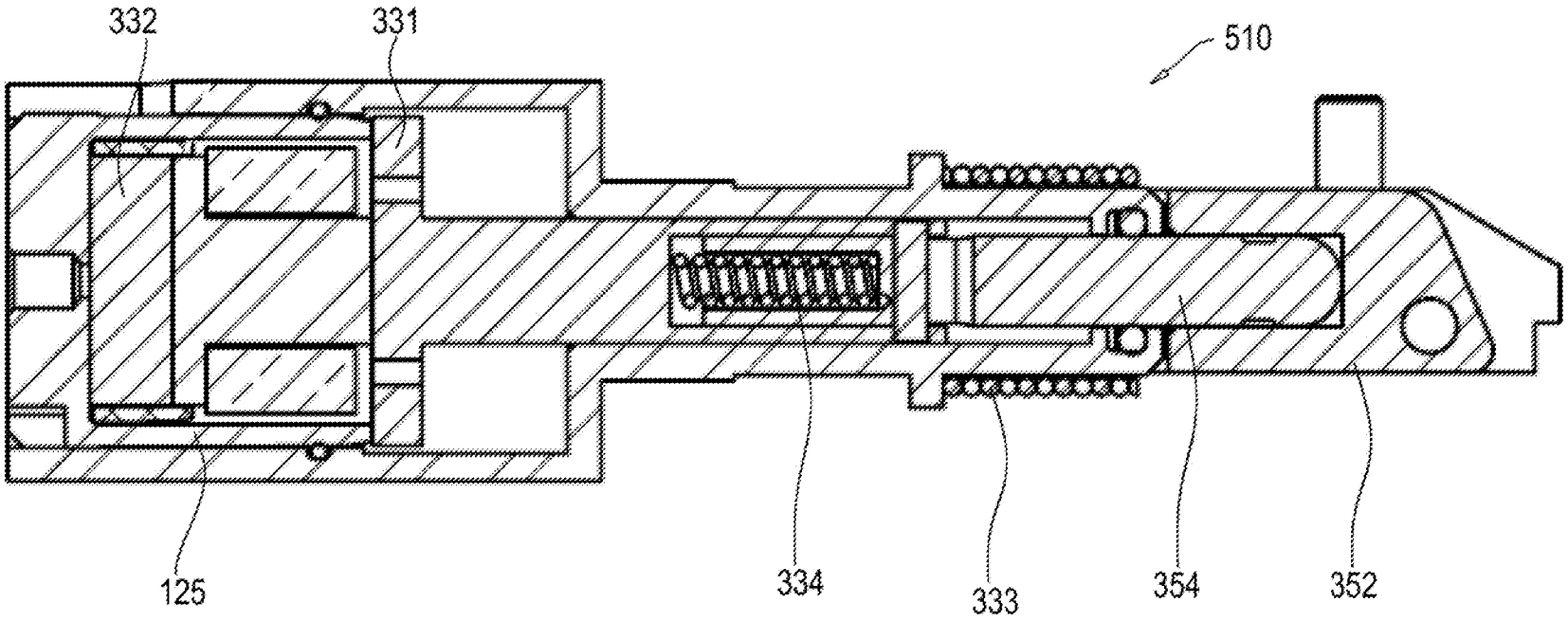
FIGS. 3A, 3B and 3C are schematic illustrations of cross sections of an Electro Mechanical Energy storing (EMES) mechanism, the illustrations show different designs that the mechanism may take, according to some embodiments of the present disclosure.
Figure 3B:
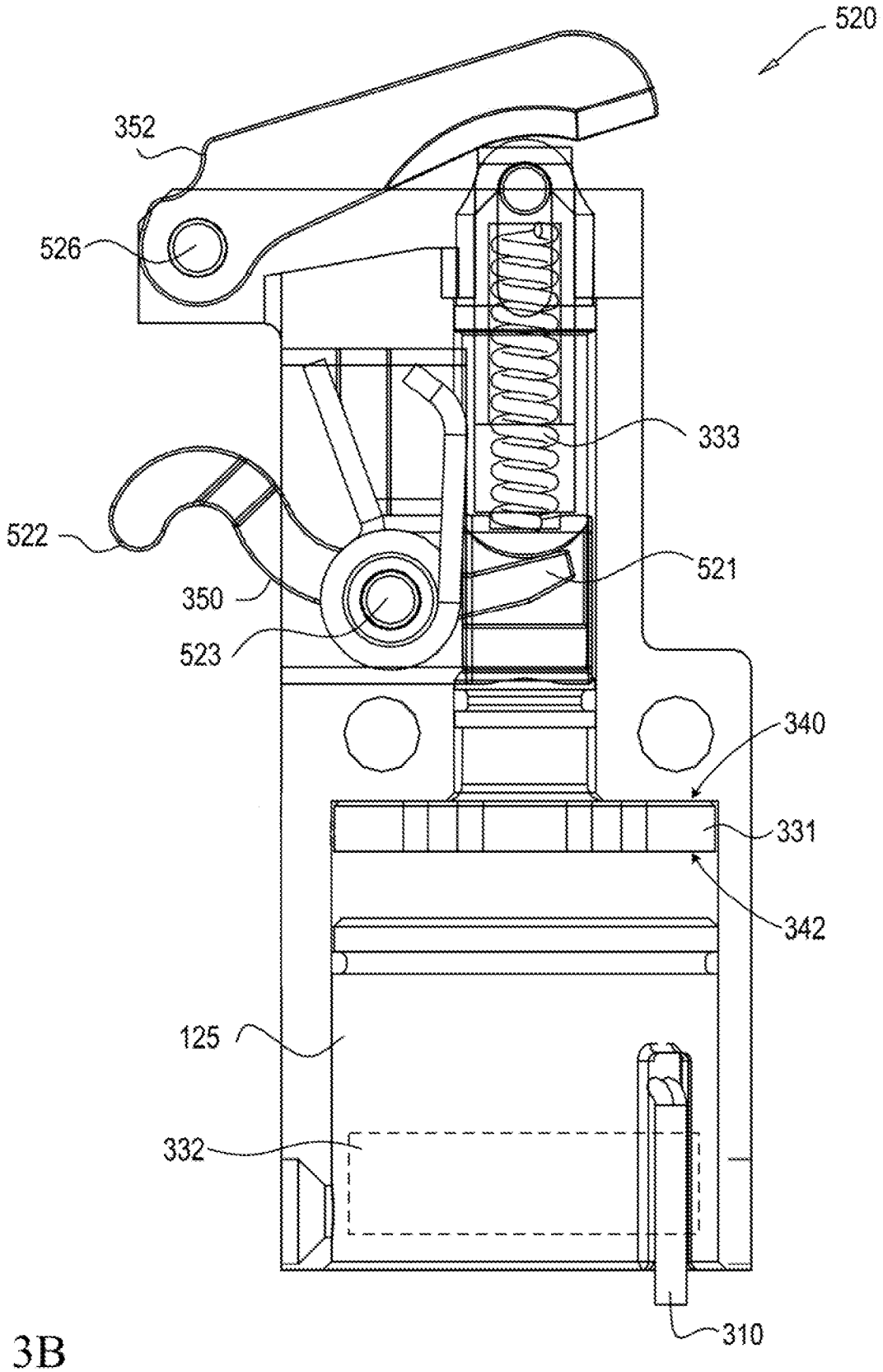
Figure 3C:
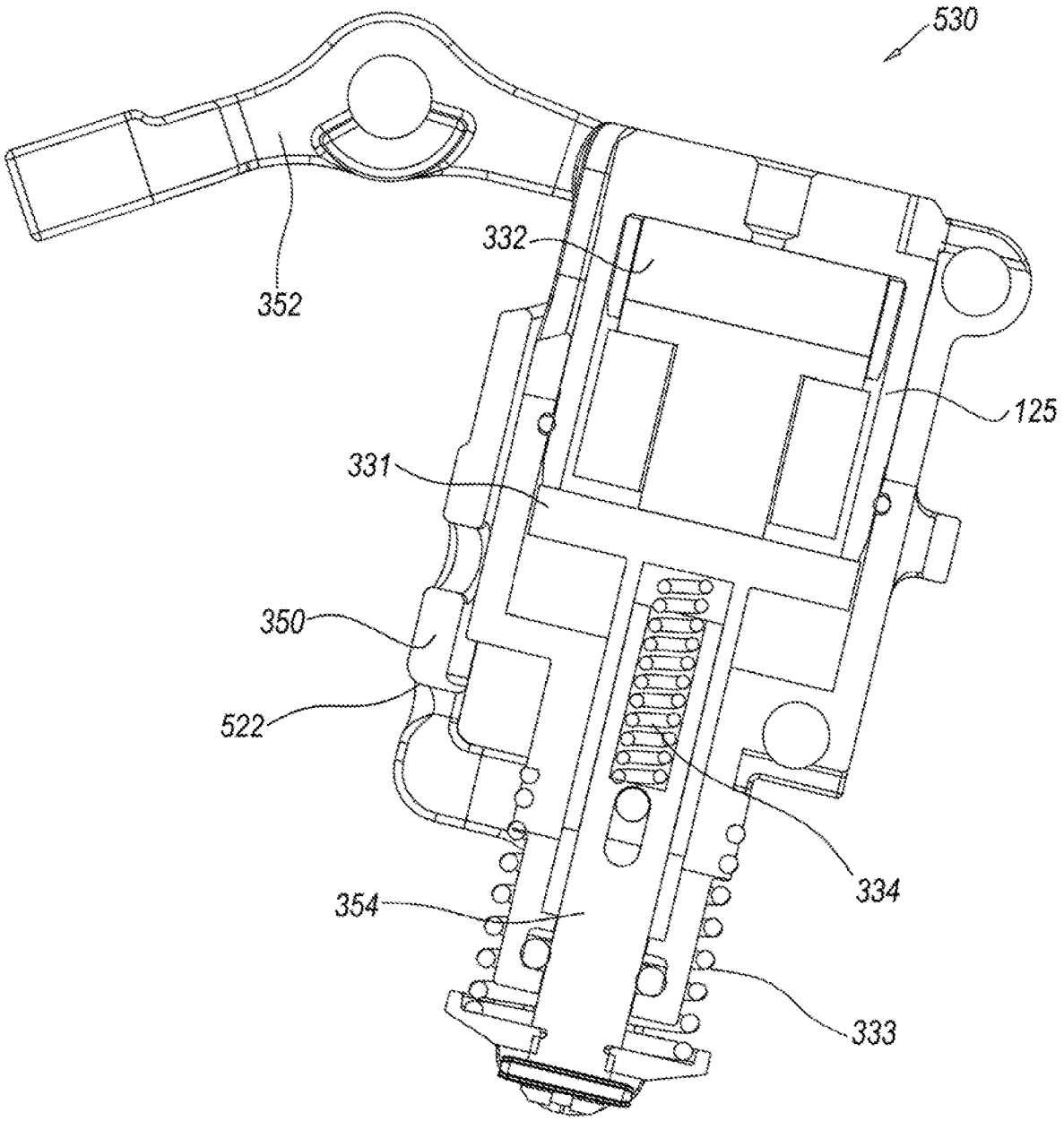

Reference is now made to FIGS. 3A, 3B and 3C, which are schematic illustrations of cross sections of Electro Mechanical Energy Storing (EMES) mechanisms 510, 520 and 530, respectively, according to some embodiments of the present disclosure. In some embodiments, EMES mechanisms 510, 520 and 530 may be variations of EMES mechanism 500 (FIG. 1). According to some embodiments of the present disclosure, an energy storing mechanism, e.g. EMES mechanism 500, may store some of the mechanical energy which may be produced by at least one movable mechanical element participating in the firing process of the firearm. For example, Mechanical Energy Storing (MES) mechanism 120 may store some of the residual energy used to cock the firearm, manually and/or automatically, and store it for later use, e.g. by using spring 333. For example, MES mechanism 120 may enable further control of the releasement of the firearm from a cocking position, which may result in the firing of a firearm, as described herein. FIG. 3A illustrates EMES mechanism 510 in a horizontal position. As illustrated, when mechanical energy from at least one movable element participating in the firing process, for example bolt carrier assembly 220, is applied to bar 352 it may in turn push movable plate 331 towards magnet 332 and/or electromagnet 125. Movable plate 331 may be comprised from a first face 340 and a second face 342 substantially facing different directions, for example, first face 340 and second face 342 may face opposite directions. First face 340 of movable plate 331 may be designed to receive mechanical energy from at least one movable mechanical element imparted to first face 340 of movable plate 331 during a firing of the firearm or by manual operation of the firearm. For example by bolt carrier assembly 220 and/or bar 352. As illustrated, magnet 332 may be a part of a structure comprising electromagnet 125, and may be strong enough to connect and/or hold movable plate 331, despite the force applied by spring 333 and/or spring 334, which may be configured to pull movable plate 331 away from magnet 332 and/or electromagnet 125 in a storing energy phase. Spring 333 may be configured to store the mechanical energy imparted to first face 340 of movable plate 331. For example by having a fixed first end and a second end connected to movable plate 331. First end of spring 333 may be fixed either to an element of EMFC apparatus 100, of EMES mechanism 500 or to an element of the firearm. It should be noted that the structure comprising electromagnet 125 may further comprise magnet 332. It should be understood that spring 333 or spring 334 can be substituted by any equivalent resilient element capable of applying returning force as result of an applied upon force, for example elastic substance or set of repelling magnets.

As described above processor 121 may activate and/or deactivate electromagnet 125. Processor 121 may use a circuitry (not shown) to generate a signal to control electromagnet 125. For example, the circuitry may convert a digital output of the processor 121 to an analog signal, thus enabling processor 121 to control the currents in the coils comprising electromagnet 125 (not shown). By controlling the currents in electromagnet 125, processor 121 may activate or deactivate the magnetic field generated and may control the force of the magnetic field and/or the direction of the magnetic field. Upon activation, electromagnet 125 may for example generate an electromagnetic force, which may be configured to repel movable plate 331. The electromagnetic force generated combined with the force of spring 333 may be sufficient to, for example overcome the force of magnet 332. By overcoming the force of magnet 332, second side of movable plate 331 may be released in a releasing energy phase. Second side of movable plate 331 may then, for example, be pulled back by spring 333. The releasement of second side of movable plate 331 may discharge the stored mechanical energy in spring 333 into a firing element in contact with movable plate 331, e.g. by using lever 522. The releasement of second face 342 of movable plate 331 from the surface of electromagnet 125 and/or magnet 332 may cause a consecutive firing of the firearm. Thereby enabling processor 121, using circuitry, to control electromagnet 125 and the firing of the firearm as detailed below.

Once the firing conditions have ended (as will be elaborated with respect to FIGS. 8 and 9), and movable plate 331 is connected to magnet 332, the firearm may not fire any more rounds, even though the trigger is engaged. Upon the disengagement of trigger 105 the system may be reset. The reset of the system may for example, enable a new firing session.

In some embodiments, when mechanical energy is received, for example from at least one movable mechanical element during a firing of the firearm or by manual operation of the firearm, bar 352 may impart the energy to first face 340 of the movable plate 331. The imparted energy, i.e. force, may cause second face 342 of movable plate 331 to contact the surface of magnet 332 and/or electromagnet 125. When second face 342 of movable plate 331 is in contact with the surface of magnet 332 and/or electromagnet 125 it may cause spring 333 to store the imparted mechanical energy, for example, in a storing energy phase. When a destructive force is applied to the surface of magnet 332 and/or electromagnet 125 it may, damage the mechanism and/or one or more of the elements comprising it. In order to prevent damage to EMES mechanism 500 and/or the one of the elements comprising it, and thus to EMFC apparatus 100, in some embodiments, spring 334 and rod 354 may be added to the system. For example, spring 334 may connect movable plate 331 to bar 352 via rod 354. Spring 334 may be attached to movable plate 331 and be configured to prevent second face 342 of movable plate 331 from damaging the surface of magnet 332 and/or electromagnet 125. For example by absorbing some of the force applied on to bar 352 via rod 354. Therefore the force transferred to movable plate 331 may, be enough to cause movable plate 331 to connect to the surface of magnet 332 and/or electromagnet 125 but not enough to damage magnet 332, electromagnet 125, the apparatus and/or the elements comprising it. Spring 334 may, operate as a shock absorber, preventing movable plate 331 from impacting magnet 332 and/or electromagnet 125 with a destructive force which may cause breaking and/or damaging of magnet 332, electromagnet 125, movable plate 331 and/or the malfunction of EMES mechanism 500, and thus of EMFC apparatus 100. As illustrated in FIG. 3A spring 334 may, be configured to pull and/or push movable plate 331 according to the force transferred from bar 352 and/or the configuration of spring 333. For example, if spring 333 is configured to pull movable plate 331 away from magnet 332 and/or electromagnet 125. Then, when force is applied on to bar 352 and transferred to rod 354, pushing movable plate 331 towards magnet 332 and/or electromagnet 125, spring 334 may be configured to push back rod 354 so as to reduce the force applied on to movable plate 331. In some embodiments spring 334 may be configured to pull or push movable plate 331 in an opposite direction of spring 333, preventing movable plate 331 from encountering magnet 332 and/or electromagnet 125 with a destructive force. In some embodiments bar 352 may be an extension and/or an integral part of movable plate 331. Consequently, bar 352 may comprise a first face 340 and a second face 342, which may face substantially different directions, for example, first face 340 and second face 342 may face opposite directions. In some embodiments first face 340 may be designed to receive mechanical energy from at least one movable mechanical element imparted to first face 340 during a firing of the firearm or by manual operation of the firearm and second face 342 may be designed to contact the surface of magnet 332 and/or electromagnet 125, as described above.

As illustrated in FIG. 3B, in some mechanical firing mechanisms, a bolt carrier assembly and/or a slider may slide back and forth, generating mechanical energy, as a result of firing the firearm. Some of the generated mechanical energy may be imparted to the first face 340 of movable plate 331. For example, when the bolt carrier assembly and/or the slider slide over bar 352 it may be pushed down, in a rotation motion around pin 526. When pushed down, bar 352 may for example apply pressure on to movable plate 331, which may result in pushing movable plate 331 towards magnet 332 and/or electromagnet 125. During its motion, movable plate 331 may for example move sear lever first end 521, which may, result in the movement of second end 522 of sear lever 350, which may rotate around pin 523. Magnet 332 may attract movable plate 331 causing second face 342 of movable plate 331 to connect to it (to magnet 332) and causing spring 333 (FIG. 3A) to store energy. When energy is stored in spring 333, spring 333 may apply force on to movable plate 331 in a storing energy phase (illustrated in FIG. 3A), for example by pulling movable plate 331 away, as illustrated in FIG. 3A and described above. The second face 342 of movable plate 331 may be connected to magnet 332 until processor 121 directs power from power source 122 to generate an electrical current that may for example run via cable 310 and activate electromagnet 125. When activated, electromagnet 125 may generate a magnetic field that may be configured to repel movable plate 331. The magnetic field generated, in combination with the force applied by spring 333 may for example, be sufficient to overcome the force of magnet 332, which may result in the detachment of movable plate 331 from the surface of magnet 332, for example in a releasing energy phase. When movable plate 331 is detached from the surface of magnet 332 and/or electromagnet 125 spring 333 may discharge the stored mechanical energy. Movable plate 331 may then be pulled back to its original place, for example by the force applied by spring 333, in a releasing energy phase. Some of the mechanical energy stored in spring 333 may be discharged and directed into a firing element in contact with movable plate 331. For example, the motion of movable plate 331 may, cause first end 521 to also move. Since first end 521 and second end 522 of sear lever 350 are connected, the motion of first end 521 may cause second end 522 to also move accordingly. As a result of the movement of sear lever 350, hammer 210 may be released from its cocking position and may strike the firing pin.

EMES mechanisms 510, 520 and 530 may be used to electronically control the fire rate of a firearm. Processor 121 may control the activation and/or deactivation of electromagnet 125. Movable mechanical elements participating in the firing process of the firearm such as a bolt carrier assembly and/or a slider may move back and forth when firing a round. Which may result, in the attachment of second face 342 of movable plate 331 to magnet 332 and the movement of first end 521 and second end 522 of sear lever 350 as described above. The movement of first end 521, when movable plate 331 is pushed towards magnet 332 and/or electromagnet 125, may enable cocking of hammer 210. It should be noted that the movement of any of the movable elements participating in the firing process of the firearm such as hammer, firing pin, trigger and/or sear and/or manual operation may also cause movable plate 331 to be pushed and/or attach to magnet 332. When a signal is received from processor 121 using a circuitry, electromagnet 125 may for example be activated, which may result in the releasement of movable plate 331 from magnet 332. When movable plate 331 is pulled back, e.g. away from magnet 332, by spring 333, spring 333 may discharge the stored mechanical energy it holds, into a firing element in contact with movable plate 331. For example, movable plate 331 may move on its way back first end 521 of sear lever 350, which may result in the movement of second end 522 and the releasement of hammer 210. Therefore processor 121, via electromagnet 125 and circuitry, may control the releasing intervals of hammer 210, slider 604 (as described later on) and/or other mechanical elements participating in the firing process of the firearm for example a sear, a bolt carrier, a bolt carrier assembly, a trigger and/or a firing pin, enabling processor 121 to control the fire rate. This is possible as long as the mechanical mechanism enables it, e.g. the trigger is pulled or engaged, the safety lever is set to the appropriate operation mode and the bolt carrier assembly and/or slider move back and forth cocking movable plate 331, hammer 210, firing pin (not shown) and/or other mechanical elements participating in the firing process of the firearm.

It should be noted that movable plate 331 may be comprised from a variety of different materials, shaped in a verity of forms that may possess magnetic or paramagnetic characteristics adapted to be pulled by a magnet and/or an electromagnet.

According to some embodiments of the present disclosure, EMES mechanism 500 may operate slightly different than described above. For example, EMES mechanism 500 e.g., any of mechanisms 510, 520 and/or 530 may not require magnet 332. For example, electromagnet 125 may operate constantly, upon activation, to attract movable plate 331 and upon receiving a signal from processor 121 it may deactivate, which may cause movable plate 331 to be pulled back by spring 333. Furthermore, EMES 500 may work the other way around e.g. spring 333 may be pushing movable plate 331. For example, movable plate 331 may be pushed by spring 333 towards magnet 332, magnet 332 may repel movable plate 331 and the force applied by electromagnet 125 may attract movable plate 331 and not repel it. Therefore, movable plate 331 may connect to and/or disconnect from magnet 332 according to the magnetic field applied by activating and/or deactivating electromagnet 125.

Figure 3D:
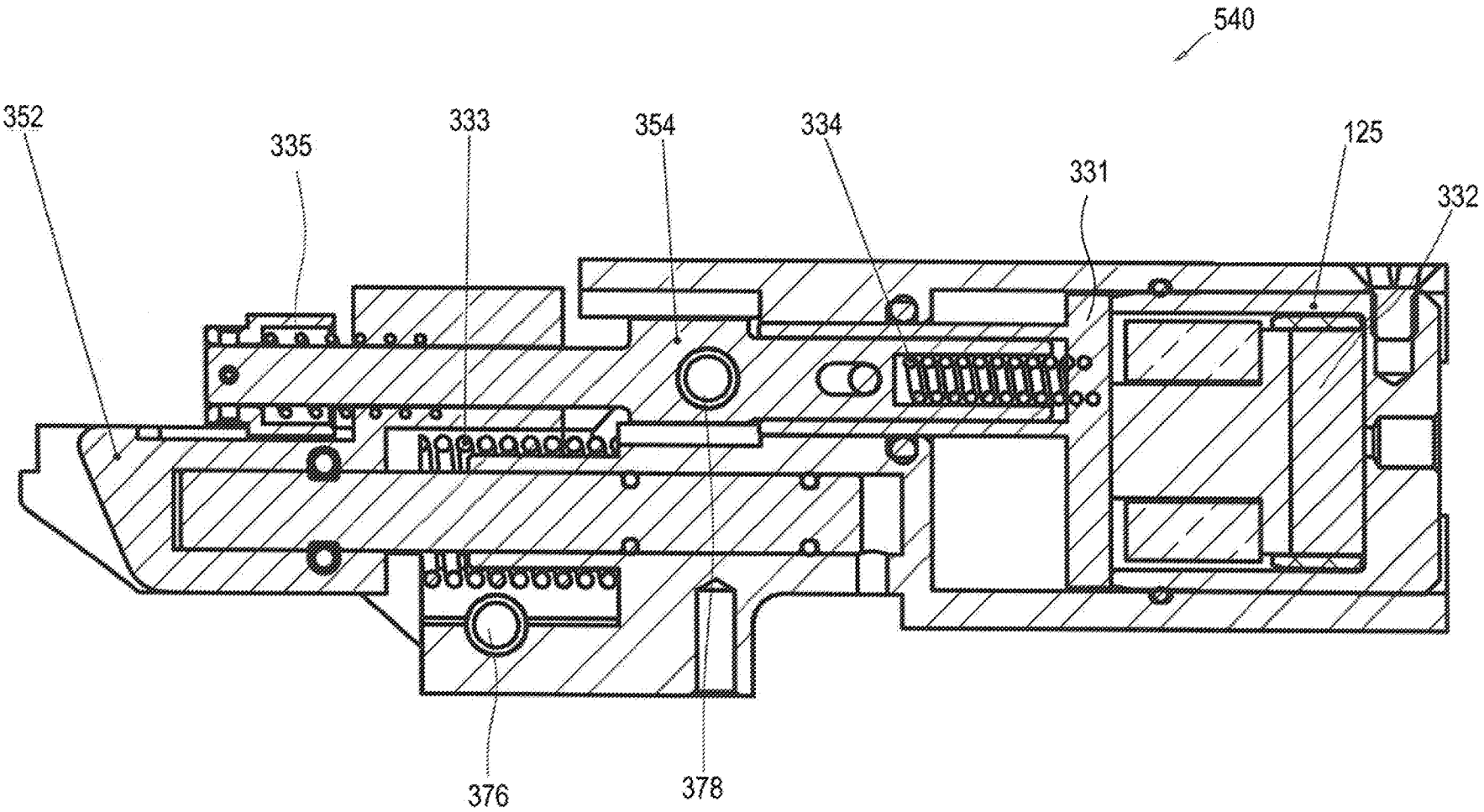
FIGS. 3D and 3E are schematic illustrations of a cross section and a side-view, respectively, of an Electro Mechanical Energy Storing (EMES) mechanism including a Force Dividing system, according to some embodiments of the present disclosure.
Figure 3E:
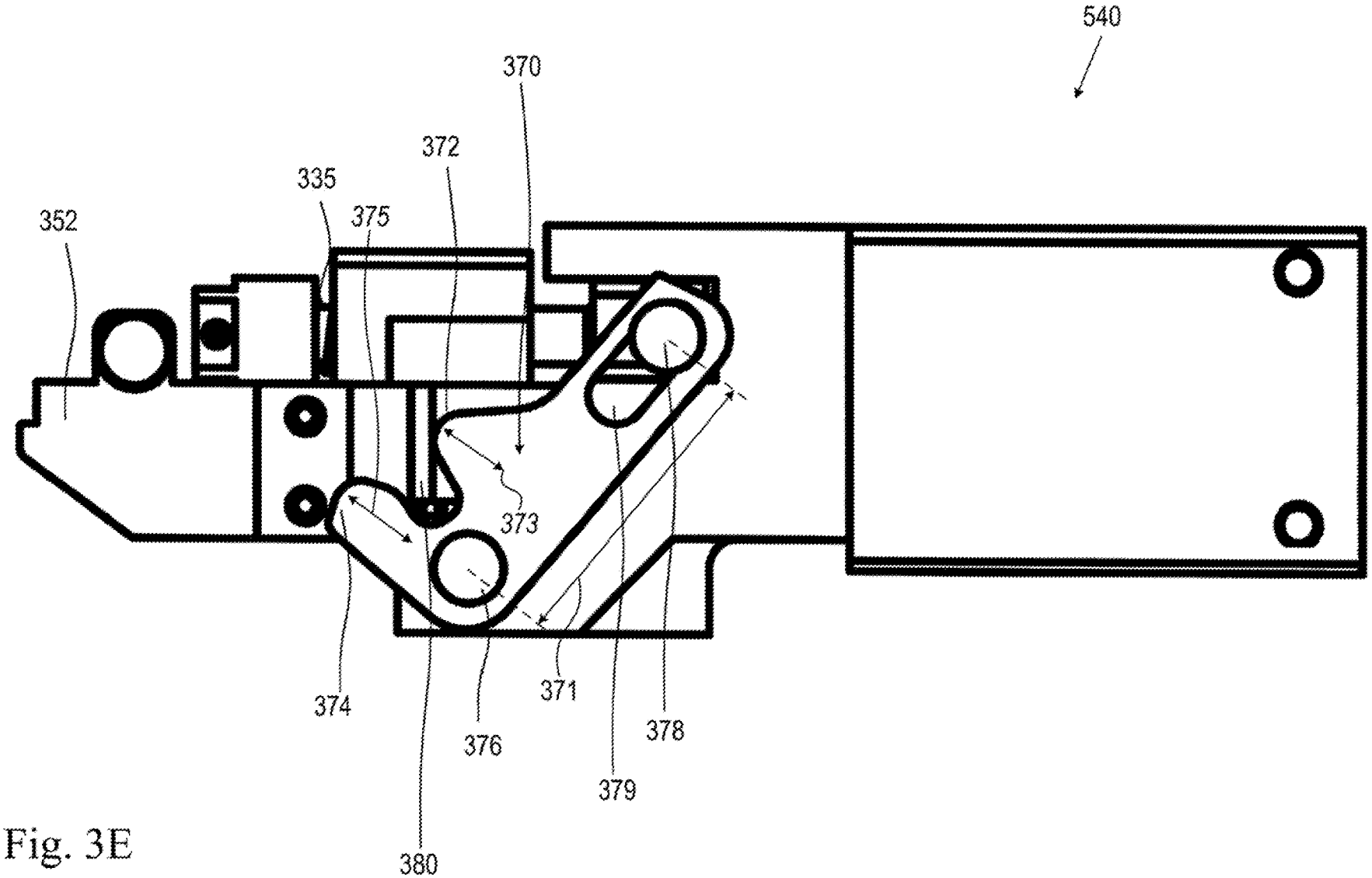

Reference is now made to FIGS. 3D and 3E, which are schematic illustrations of cross section and side-view, respectively, of Electro Mechanical Energy Storing (EMES) mechanism 500 including a Force Dividing (FD) system, according to some embodiments of the present disclosure. As described above, the EMES mechanism 500 may store some of the mechanical energy, which may be produced by at least one movable mechanical element participating in the firing process of the firearm. Some firing systems may generate and/or require more mechanical energy upon firing the firearm and/or when manually operating the firearm compared to other firing systems. For example, the IWI NEGEV® Light Machine Gun (LMG) mechanical firing system may generate and/or require energy which is around five times higher than the energy generated and/or required by—the standard M16. Storing energy, which is around five times higher, may require the EMES mechanism 500 to implement a powerful spring, which may in turn dictate the need for a powerful magnet and/or electromagnet. In order to avoid the use of a powerful magnet and/or electromagnet, which may take more space and/or require more power from power source 122, a Force Dividing (FD) system may be introduced. As illustrated in FIGS. 3D and 3E, in mechanism 540 comprising an EMES mechanism with a FD system, bar 352 may be coupled to rod 354, using at least one FD lever, e.g., bar 352 may be positioned parallel to rod 354 using FD lever 370, as a connector therebetween. As a result of this configuration, bar 352 may impart some of the mechanical energy to rod 354 via the at least one FD lever, for example, FD lever 370. FD lever 370 may be a lever and a fulcrum point, configured to reduce force applied to magnet 332 and/or electromagnet 125, which may be produced by at least one movable mechanical element participating in the firing process of the firearm or by manual operation of the firearm. FD lever 370 may further be configured to increase the holding force of magnet 332 and/or electromagnet 125, which may be used to store energy in spring 333.

FD lever 370 may comprise at least one arm 371 pivotally mounted at fulcrum point 376 and may have at least one engaging point, e.g., engaging points 372, 374, and 378. In some embodiments, FD lever 370 may further comprise a slot, e.g., slot 379. For example, the slot, e.g., slot 379, and/or the at least one engaging point, such as engaging point 374, may be located on different ends of FD lever 370. In some embodiments, FD lever 370 may be shaped as the letter 'F', having one first arm, e.g., arm 371 and two second arms, e.g., arms 373 and 375. In some embodiments, first arm 371 is longer than each of second arms 373 and/or 375. The two second arms 373, 375 may include at least two engaging points, e.g., engaging point 372 and engaging point 374, such that each of the engaging points 372 and 374 may be located along one of the two short arms of the 'F' shaped FD lever 370. FD lever may be configured to pivot around a first mounting point 376 located along the at least first arm 371 to create a fulcrum. For example, first mounting point 376, may be located along the long arm 371 of the 'F' shaped FD lever 370, for example, between short arms 373 and 375 of the 'F' shaped FD lever 370 or at the meeting point of either of short arms 373 and 375 and long arm 371, in order to create a fulcrum. FD Lever 370 may be mounted at pivotal mounting point 376 to another FD lever located substantially on an opposite side of mechanism 540 and/or other element of EMFC apparatus 100, EMSE mechanism 500 and/or to an element of the firearm. FD lever 370 may be mounted by a pin, a screw, a nail and/or any other fastening means and/or methods enabling the mounting of elements with pivoting capabilities.

Additionally, FD lever 370 may comprise a slot, such as slot 379, which may be located along the long arm 371 of the 'F' shaped lever. FD lever 370 may slide and/or rotate around a certain point, e.g. second mounting point 378 via slot 379. Second mounting point 378 may be located along and on an opposite end of the long arm 371 of the 'F' shaped lever, i.e., opposite first mounting point 376. FD lever 370 may be mounted at second mounting point 378 to rod 354, first face 342 of movable plate 331, another lever substantially located on an opposite side of mechanism 540, and/or other element of EMFC apparatus 100, EMSE mechanism 500, and/or to an element of the firearm. Second mounting point 378 may be connected to one of the disclosed elements by, for example, a pin, a screw, a nail and/or any other fastening means and/or methods enabling sliding and/or rotating capabilities. FD lever 370 may slide along and/or rotate around second mounting point 378. The pin or any other fastening means and/or methods enabling sliding and/or rotating capabilities, may be configured to slide along slot 379 and enable FD lever 370 to rotate around it.

FD lever 370 may be engaged by bar 352, for example, via protrusion 380 and engaging point 372. FD lever 370 may be used to impart energy from bar 352 to rod 354, enabling rod 354 to receive lower energy than imparted onto bar 352, for example, by a mechanical element participating in the firing process of the firearm. Alternatively, in an energy storing phase, FD lever 370 may be engaged by bar 352, which may be pushed and/or pulled by spring 333, for example, via protrusion 380 and/or engaging point 374. By creating a fulcrum, FD lever 370 may enable magnet 332 and/or an electromagnet 125 to hold bar 352 in a static position, even though the force applied to bar 352 by, for example, spring 333 is greater than the holding force applied by magnet 332 and/or electromagnet 125. Thus, the fulcrum enables the use of a less powerful magnet and/or electromagnet than otherwise required. When mechanical energy is applied onto bar 352 it may in turn push FD lever 370, for example, via protrusion 380 which may engage engaging point 372. When force is applied to FD lever 370, for example, by bar 352 via protrusion 380 and/or engaging point 372, FD lever 370 may pivot around first mounting point 376. For example, FD lever 370 may pivot around first mounting point 376, toward magnet 332 and/or electromagnet 125, e.g., FD lever 370 may rotate clockwise, imparting energy to rod 354. Rod 354 may in turn push movable plate 331 toward magnet 332 and/or electromagnet 125, as illustrated in FIG. 3D. As a result of the shape of FD lever 370 and the fulcrum point, e.g., the location of first mounting point 376, the force applied onto rod 354, for example, by bar 352 via FD lever 370, may be reduced. The reduction of the force applied may be related to the length of the arms of FD lever 370, the long arm 371 and short arm 373 and/or short arm 375 of FD lever 370. In some embodiments the length of long arm 371 may refer to the distance created between second mounting point 378 and the meeting point of the long arm 371 with either one of the short arms of FD lever 370.

When second face 342 of movable plate 331 is connected to the surface of magnet 332 and/or electromagnet 125, spring 333 may apply force to bar 352 pushing and/or pulling bar 352. For example, spring 333 may push and/or pull bar 352 away from magnet 332 and/or electromagnet 125. When force is applied by spring 333 to bar 352, protrusion 380 may in turn engage and apply force to FD lever 370 via engaging point 374. Magnet 332 and/or electromagnet 125, which hold plate 331 in contact with the surface of magnet 332 and/or electromagnet 125, may consequently hold rod 354 in a static position. When rod 354 is being held in a static position as described above, it may in turn prevent FD lever 370 from pivoting. For example, preventing FD lever 370 from pivoting around first mounting point 376, such as away from magnet 332 and/or electromagnet 125, e.g., rotating FD lever 370 counter clockwise. When FD lever 370 is being held in a static position, for example, by rod 354 and/or movable plate 331, as described above, and when spring 333 applies force, for example, onto bar 352, protrusion 380 may engage engaging point 374. When FD lever 370 is being held in a static position, engaging point 374 may also hold bar 352, via protrusion 380, in a static position, overcoming the force applied by spring 333. Magnet 332 and/or electromagnet 125, which hold movable plate 331 in contact with the surface of electromagnet 125 may thus hold bar 352 in a cocked position. That is, the holding force applied by magnet 332 and/or electromagnet 125 by implementing the configuration of FD lever 370 and/or rod 354 may overcome the force applied by spring 333, as described above. Holding bar 352 in a cocked position i.e., overcoming the force of spring 333, may be possible due to the fulcrum and/or the levers created by the design of FD lever 370. As a result of the shape of FD lever 370 and the location of first mounting point 376 that creates the fulcrum, the holding force applied to bar 352, for example, by magnet 332 and/or electromagnet 125, may be enhanced. The enhancement of the holding force applied onto bar 352 may be related to the length of arms of FD lever 370 long arm 371 and either of short arm 373 and/or arm 375 of FD lever 370. For example, the length of a lever (which may be equivalent to the length of the long arm 371 of FD lever 370) may be defined by the distance created between the meeting point of long arm 371 and one of the short arms, such as short arm 375, and second mounting point 378 of FD lever 370.

According to some embodiments, in order to further reduce the force applied to rod 354 by the mechanical energy, as described above, and to synchronize the motion of rod 354 with the motion of bar 352, spring 335 may be added to the system. For example, spring 335 may have a fixed first end and a second end connected to rod 354, which may be configured to apply force in an opposite direction from the force applied by magnet 332 and/or electromagnet 125, e.g., pulling and/or pushing rod 354 towards and/or away, magnet 332 and/or electromagnet 125.

Consequently, magnet 332 and/or electromagnet 125 may be required to apply a holding force strong enough to overcome the reduced force applied by spring 333 and the force applied by spring 335. The force applied by magnet 332 and/or electromagnet 125 may be required to overcome the force of spring 333, while incorporating the principle of moments, as illustrated in equation (1):

$$F_m > \frac{F_{s1} * l_2}{l_1} + F_{s2} \tag{1}$$

Wherein: $F_{s1}$ denotes the force applied by spring 333; $F_m$ denotes the holding force applied by magnet 332 and/or electromagnet 125; $l_1$ denotes the length of long arm 371, i.e., the distance created between first mounting point 376 and second mounting point 378; $F_{s2}$ denotes the force applied by spring 335 and/or spring 334; $l_2$ denotes the length of short arm 375, for example, the distance created between the meeting point of both short arm 375 and long arm 371 and engaging point 374.

According to equation (1) incorporating a lever, e.g., FD lever 370 into mechanism 500, e.g., mechanism 540, enables use of a more powerful spring 333 to be held in an energy storing phase without the need of using a more powerful magnet 332 and/or electromagnet 125, as would otherwise be required in case no lever was implemented in mechanism 540. That is, a lever enables reduction of the force of spring 333 projected onto magnet 332 and/or electromagnet 125.

It should be understood that an FD lever may be comprised of a variety of different materials, for example, metal, plastic, carbon fibers, polymer, composite materials and/or any combination thereof. FD lever may be shaped in different forms, for example, one lever comprising two mounting points located in two slots at opposite ends of the lever, an "L" shaped lever having only one short arm and one long arm, a piston, a spring or any other system and/or element enabling the reduction and/or the enhancement of energy and/or force, and/or any element capable of forwarding a reduced and/or an enhanced force as a result of force applied thereon.

In some embodiments, FD lever 370 may pivot around a pivotal point, which may be located in substantially any location within the firearm system. This may enable the designer of the firearm to locate the FD system in a plurality of possible locations, not limited to a specific location along the EMFC apparatus. For example, the pivotal point may be an external pivoting point, located on an external pivoting axis, which may be located externally to FD lever 370, e.g., not located along long arm 371. FD lever 370 may pivot around such external pivoting axis, to create a fulcrum.

Figure 4A:
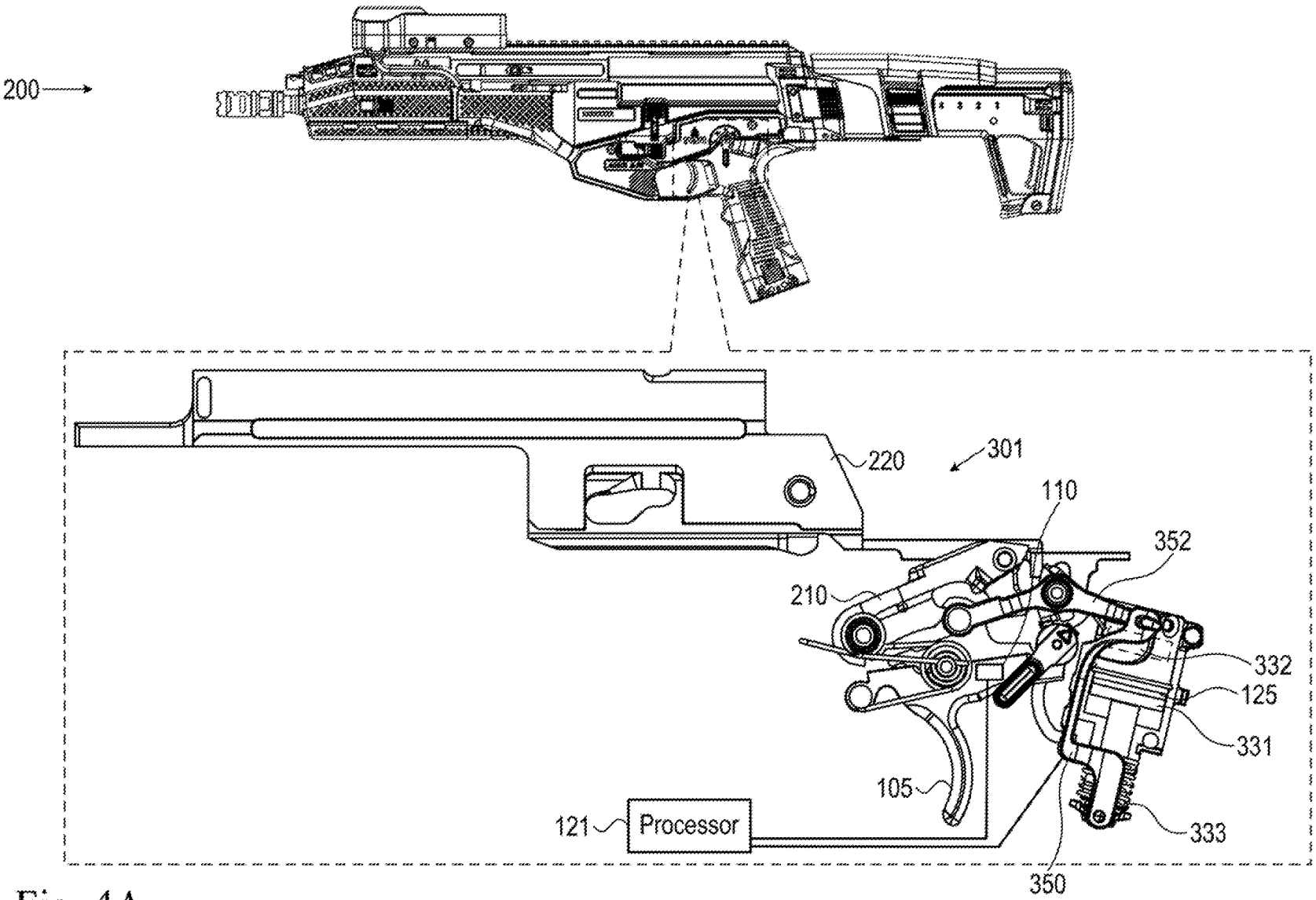
FIG. 4A is a schematic illustration of a cross section of an Electro Mechanical Fire Control (EMFC) apparatus in combination with a mechanical firing mechanism and their suggested location in a firearm, the illustration shows the EMFC apparatus and the mechanical firing mechanism in a cocked position, according to some embodiments of the present disclosure.
Figure 4B:
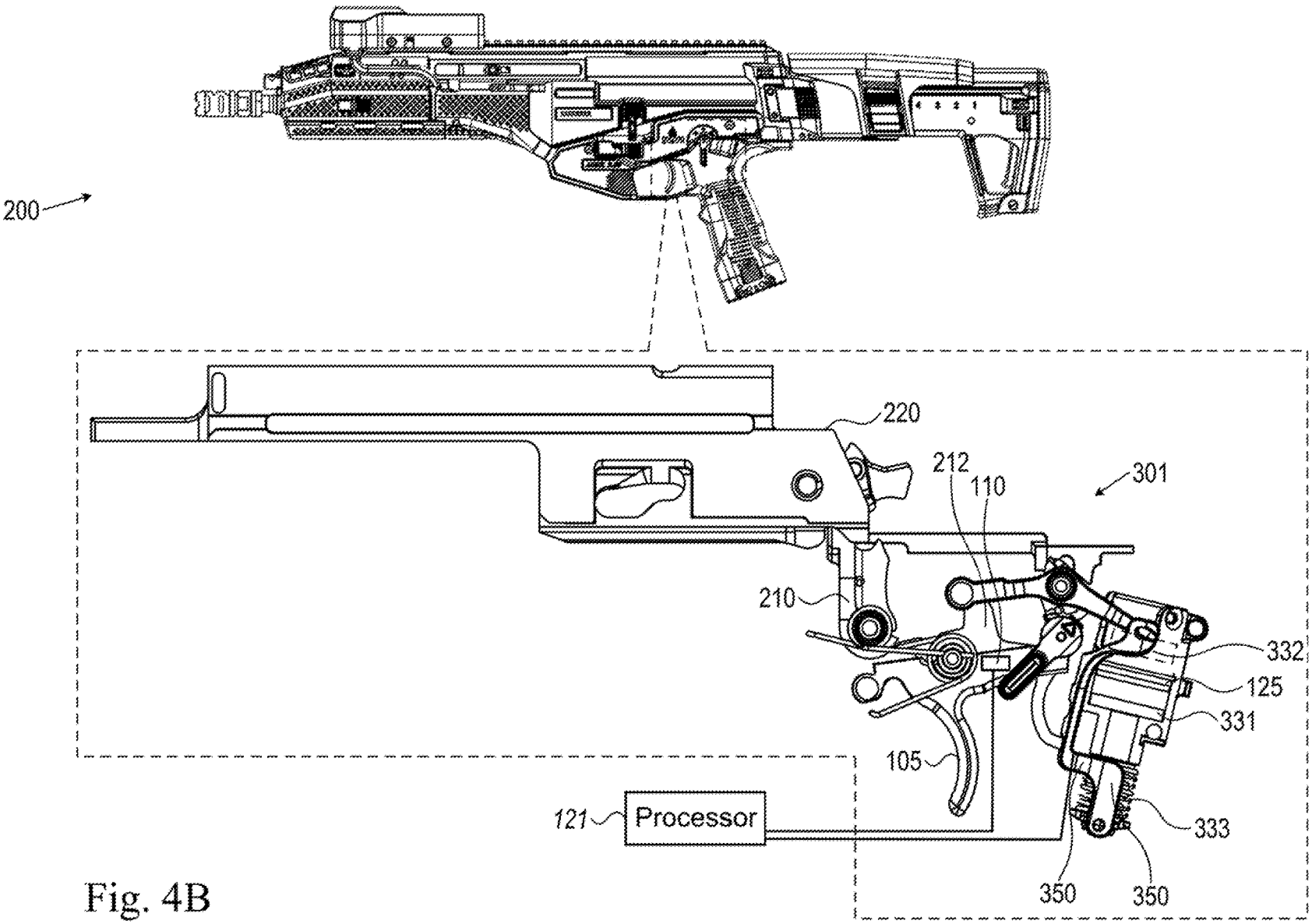
FIG. 4B is a schematic illustration of a cross section of an Electro Mechanical Fire Control (EMFC) apparatus in combination with a mechanical firing mechanism and their suggested location in a firearm, the illustration shows the EMFC apparatus and the mechanical firing mechanism in a released position, according to some embodiments of the present disclosure.
Figure 4C:
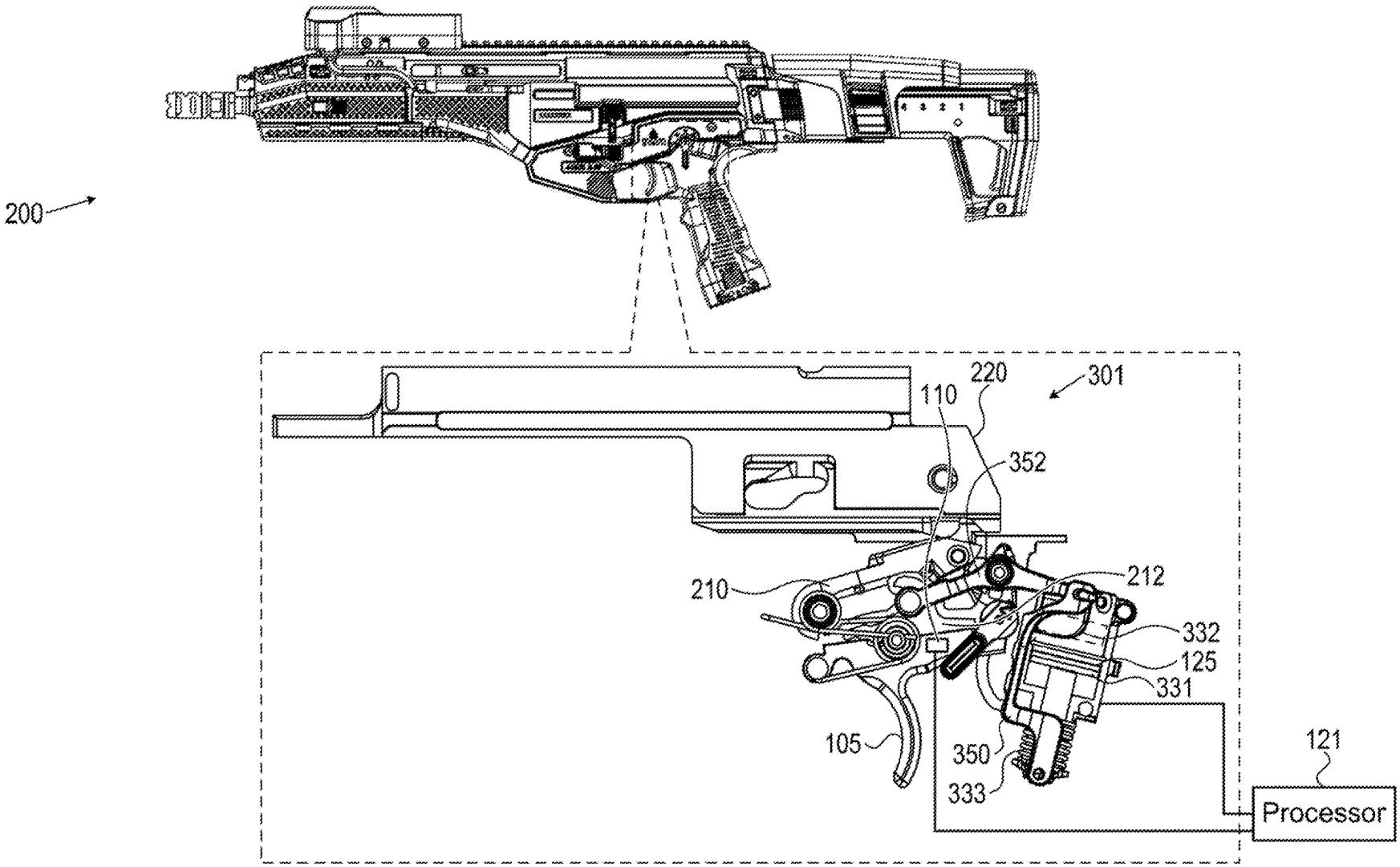
FIG. 4C is a schematic illustration of a cross section of an Electro Mechanical Fire Control (EMFC) apparatus in combination with a mechanical firing mechanism and their suggested location in a firearm, the illustration shows the EMFC apparatus and the mechanical firing mechanism during the cocking process, according to some embodiments of the present disclosure.

Reference is now made to FIGS. 4A-4C, which are schematic illustrations of cross sections of Electro Mechanical Fire Control (EMFC) apparatus in combination with a mechanical firing mechanism, as described in FIGS. 1 to 3, and their suggested location in a firearm. The figures may represent different positions of the bolt carrier assembly and EMFC apparatus, according to some embodiments of the present disclosure. The illustrations show the EMFC apparatus and the mechanical firing mechanism in a cocked and released positions and during the cocking process, respectively, according to some embodiments of the present disclosure. As illustrated in FIG. 4A, trigger sensor 110 may send an indication to processor 121 that trigger 105 is or isn't engaged. As a response processor 121 may activate and/or deactivate electromagnet 125 for example, to control the fire rate according to at least one preselected rule. According to some embodiments, when the safety lever is set to a preselected mode and EMFC 100 is activated, after the first round is fired, disconnector 212, which is responsible for retaining hammer 210 in the cocked position after a round is fired, in semi-automatic mode, may for example, be controlled by sear lever 350. Sear lever 350 may be responsible for example, for retaining hammer 210 in a cocked position and releasing it towards bolt carrier 220, resulting in the firing of firearm 200. The movement of sear lever 350 may be, for example, according to the instructions received from processor 121 to activate and/or deactivate electromagnet 125. When bolt carrier 220 slides along a rail, it may move bar 352, which may for example, cause bar 352 to push plate 331 towards magnet 332 and/or electromagnet 125, cocking the electromagnet mechanism, as described in FIGS. 3A, 3B, 5A and 5B. As illustrated, movable plate 331 may be magnetically attached to magnet 332, which may result in sear lever 350 being responsible for retaining hammer 210 in a cocked position. It should be noted that, the movement of any of the mechanical elements participating in the firing process of the firearm such as hammer, bolt carrier, bolt carrier assembly, slider, firing pin, trigger, sear and/or any combination thereof, as a result of firing of the firearm and/or an automatic and/or manual operation of the firearm, may impart mechanical energy on to the fist face of movable plate 331. First face 340 of movable plate 331 may be designed to receive the residual mechanical energy, generated from at least one movable mechanical element participating in the firing process of the firearm. The residual mechanical energy imparted to first face 340 of movable plate 331 may result in movable plate 331 being pushed towards the surfaces of magnet 332 and/or electromagnet 125, cocking the electromagnet mechanism, as described in FIGS. 3A, 3B, 4B, 4C, 5A and 5B. It should be noted that in some embodiments sear lever 350 may be an extension of disconnector 212. That is, sear lever 350 and disconnector 212 may be manufactured as one piece.

As illustrated in FIG. 4B trigger sensor 110 may indicate processor 121 that trigger 105 is engaged. As a response to the indication received from trigger sensor 110, processor 121 may activate and/or deactivate electromagnet 125 to control the fire rate according to the preselected rules chosen by the user. According to some embodiments, as illustrated, when the safety lever is set to a preselected mode and EMFC 100 is activated, after the first round was fired, disconnector 212, may be configured to retain hammer 210 in the cocked position after a round is fired. In a semi-automatic mode, hammer 210 may be, controlled by sear lever 350 which may for example be adapted to retain hammer 210 in a cocked position and release it. The releasement of hammer 210, towards bolt carrier assembly 220 may be for example, according to the activation and/or deactivation of electromagnet 125. As illustrated, movable plate 331 is released from magnet 332, and therefore may be pulled by spring 333. The motion of movable plate 331 may result in the movement of sear lever 350, as described above. When movable plate 331 is pulled away from magnet 332 and/or electromagnet 125 it may move sear lever 350 in such a manner that it may release hammer 210 from its cocked position, according to some embodiments of the present disclosure.

FIG. 4C illustrates how the EMFC apparatus may be combined along with a mechanical firing system, as illustrated in system 301 after firing a round, according to some embodiments of the present disclosure. After firearm 200 fires, bolt carrier assembly 220 may slide in a rail. When bolt carrier assembly 220 slides toward the rear of the firearm, it may pivot hammer 210 to its starting position, e.g. where it is cocked. When hammer 210 is in its starting position, disconnector 212 may lock hammer 210 retaining it in its cocked position. Sliding of bolt carrier assembly 220 and/or a slider to the rear of the firearm, may also apply force on to bar 352. When pressured, bar 352 may push movable plate 331 towards magnet 332 and/or electromagnet 125 cocking it, as described in FIGS. 3A, 3B, 5A and 5B.

Figure 5A:
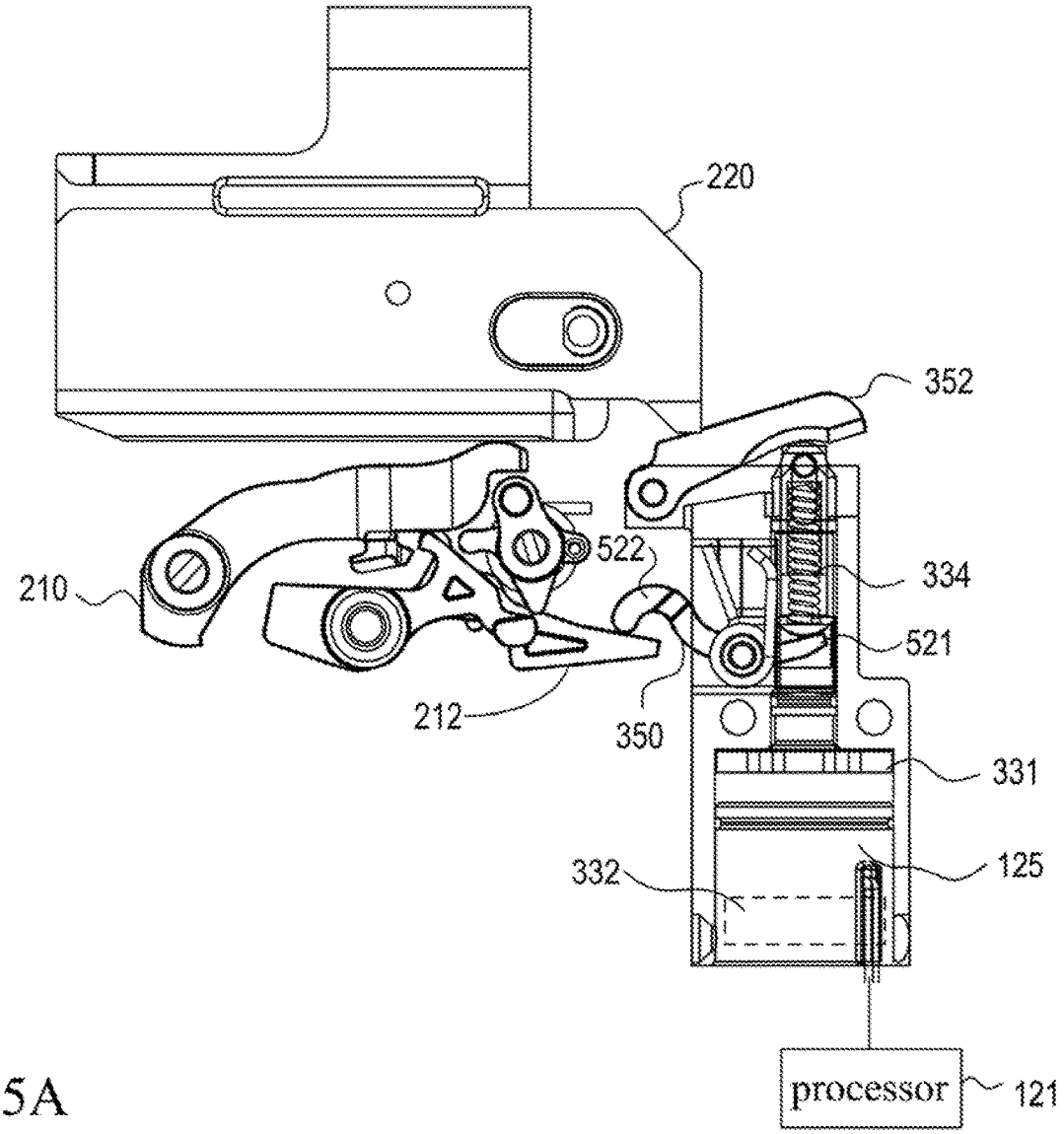
FIGS. 5A and 5B are schematic illustrations of a cross section of an Electro Mechanical Fire Control (EMFC) apparatus in combination with a mechanical firing mechanism, in released position and cocked position, respectively, the illustrations show different positions of the EMFC apparatus with respect to position of the bolt carrier assembly, according to some embodiments of the present disclosure.
Figure 5B:
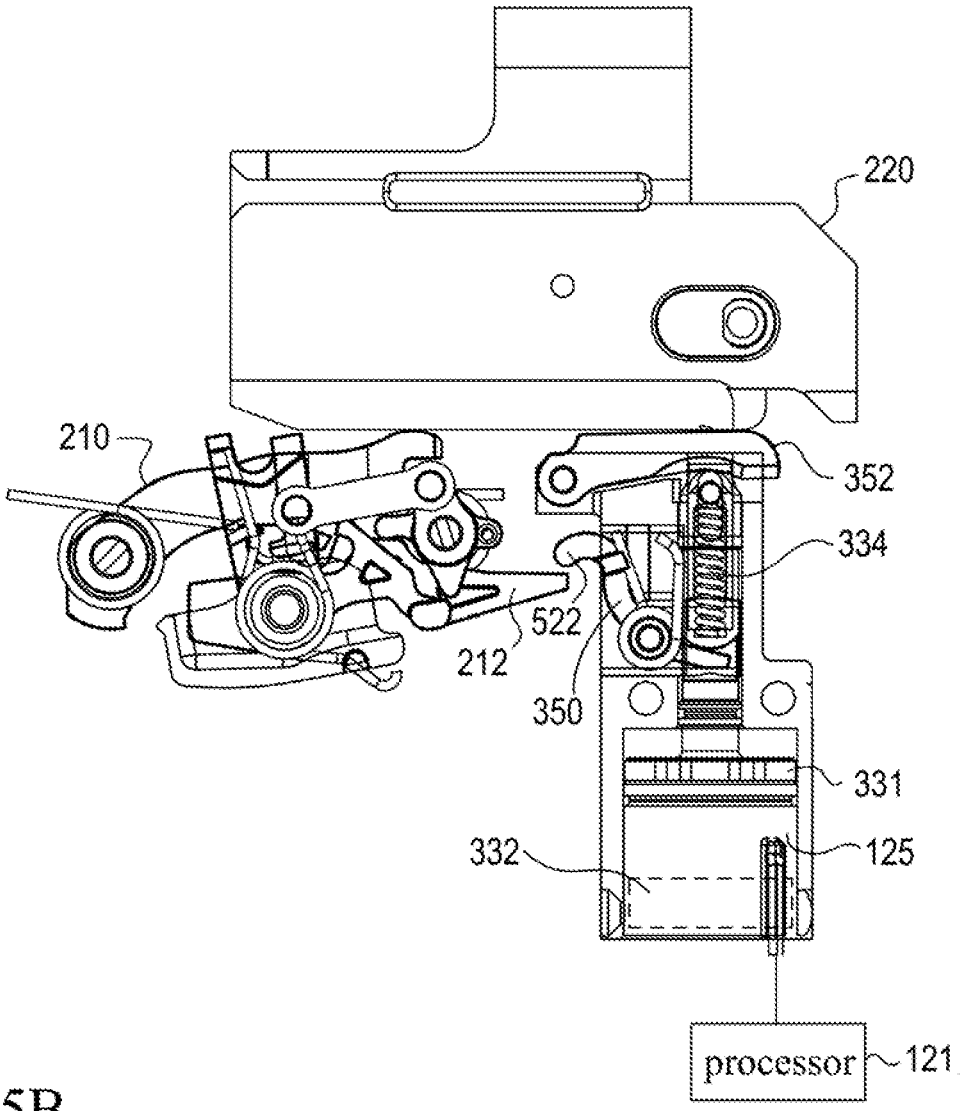

Reference is now made to FIGS. 5A and 5B, which are schematic illustrations of a cross section of an Electro Mechanical Fire Control (EMFC) apparatus in combination with a mechanical firing mechanism, in released position and cocked position, respectively. The illustrations may represent different positions of the EMFC apparatus with respect to position of the bolt carrier assembly, according to some embodiments of the present disclosure. As illustrated in FIG. 5A bolt carrier assembly 220 is placed over hammer 210, pulling it back. However in this position of bolt carrier assembly 220, hammer 210 may not be cocked, e.g. disconnector 212 may not be engaged with hammer 210. For example, according to some embodiments, disconnector 212 may not be engaged with hammer 210 due to the force applied by sear lever 350 to the lever of disconnector 212, which may prevent disconnector 212 to engage hammer 210. As illustrated in FIG. 5A bar 352 may not apply pressure and/or push movable plate 331 towards magnet 332 and/or electromagnet 125. As illustrated, processor 121 may have activated electromagnet 125 so that movable plate 331 may be released from magnet 332. Since second face 342 of movable plate 331 may not be connected to the surface of magnet 332 and/or electromagnet 125 it may be pulled by spring 333. As a result of the motion of movable plate 331, sear lever 350 may for example, apply force on to the lever of disconnector 212. As a result of the force applied to the lever of disconnector 212, disconnector 212 may for example, no longer be engaged with hammer 210 e.g. hammer may no longer be cocked by disconnector 212. According to the illustration, since hammer 210 may not be cocked, when bolt carrier assembly 220 slides towards the front of the firearm e.g. stop applying pressure on to hammer 210, hammer 210 may be released and therefore may strike the firing pin (not shown).

As illustrated in FIG. 5B, according to some embodiments of the present disclosure, bolt carrier assembly 220 is pulled back e.g. toward the rear of the firearm, applying force on to bar 352 and rotating back hammer 210. As illustrated, as a result of the force applied, movable plate 331 may have been pushed towards magnet 332 and/or electromagnet 125 and may be connected to magnet 332. The motion of movable plate 331 may cause sear lever 350 to move in such a manner that it may no longer apply pressure on to the lever of disconnector 212. According to some embodiments, when sear lever 350 does not apply force on to the lever of disconnector 212, disconnector 212 may for example engage hammer 210. When disconnector 212 is engaged with hammer 210, hammer 210 may be locked e.g. hammer 210 is cocked, preventing the firearm from firing. Therefore, only after bolt carrier assembly 220 slides forward i.e. no longer applies force on to hammer 210 and/or bar 352, may the instructions generated by processor 121 to activate and/or deactivate electromagnet 125 be relevant. For example, the activation and/or deactivation of electromagnet 125 may cause movable plate 331 to disconnect from magnet 332 and may be pulled by spring 333. The motion of movable plate 331 may for example, move sear lever 350, which in turn may apply pressure on to the lever of disconnector 212. When sear lever 350 applies pressure on to the lever of disconnector 212, disconnector 212 may release hammer 210, so it may strike the firing pin (not shown). According to some embodiments, in this mode of operation processor 121 may control the fire rate of a firearm.

Figure 6A:
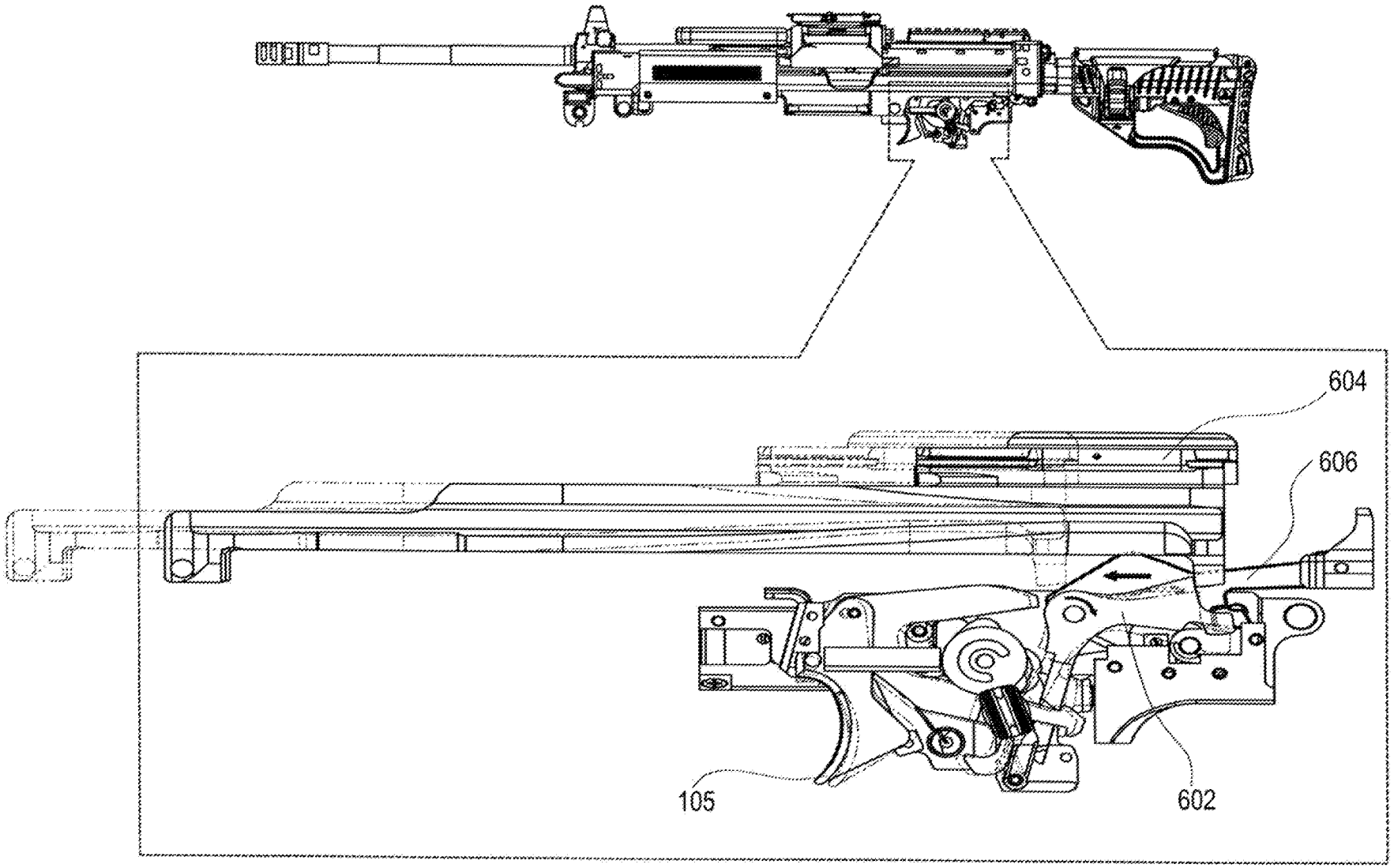
FIGS. 6A, 6B and 6C are schematic illustrations of cross sections of the left side, right side and bottom side, respectively, of an Electro Mechanical Energy Storing (EMES) mechanism including a Force Dividing (FD) system in combination with a mechanical firing mechanism, and their suggested location in a firearm, the illustrations show different angles of the mechanism, according to some embodiments of the present disclosure.
Figure 6B:
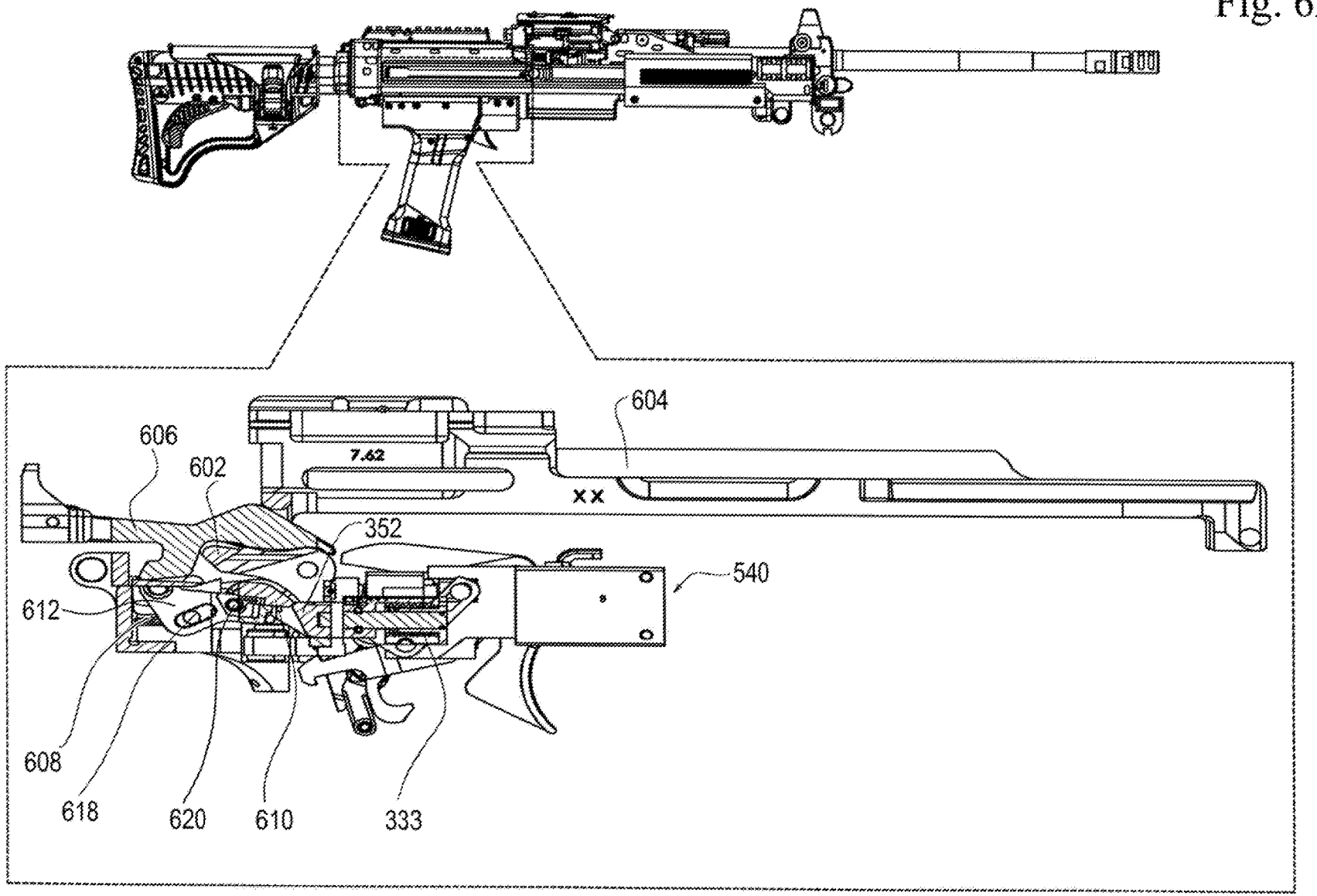
Figure 6C:
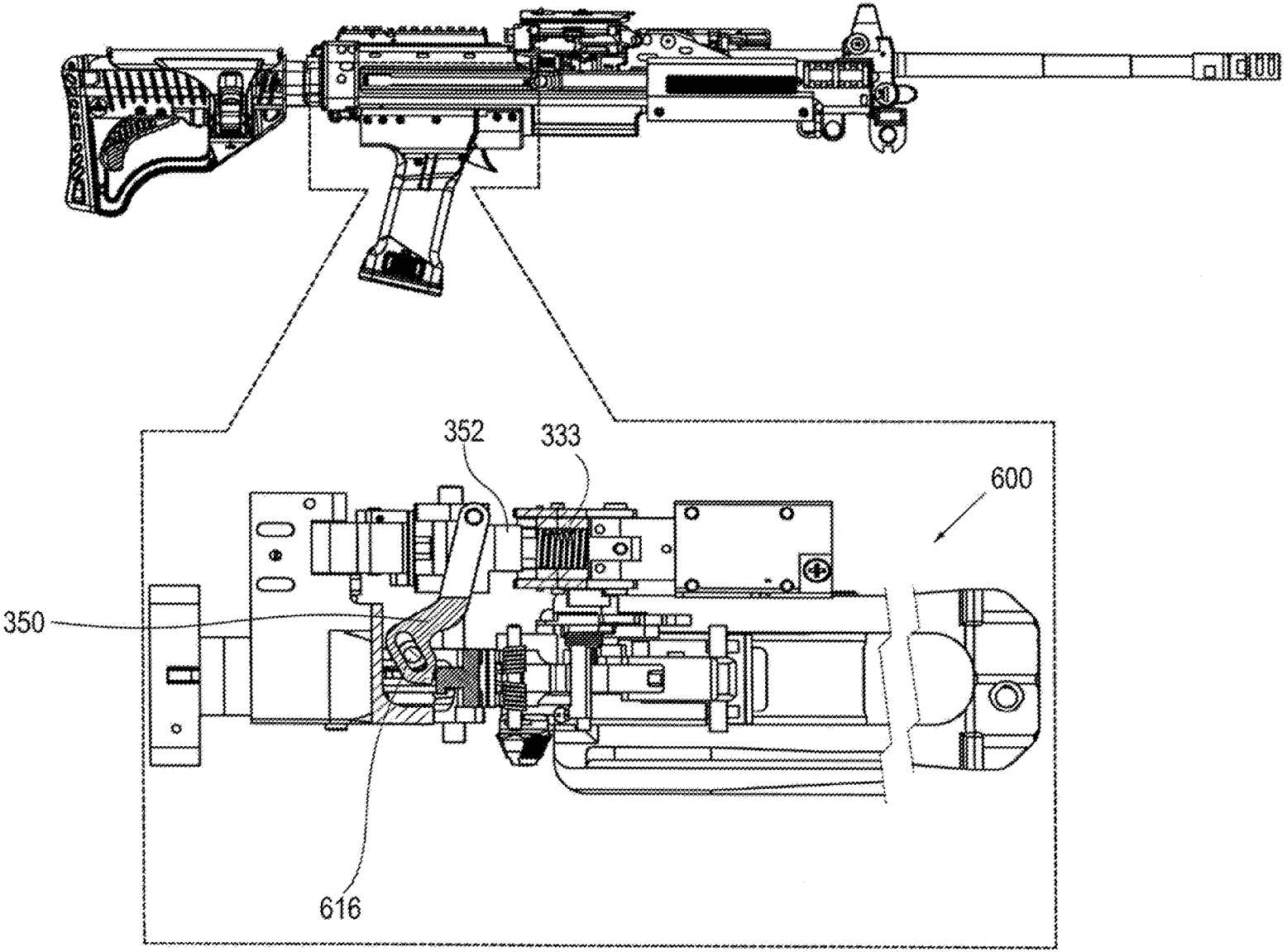

Reference is now made to FIGS. 6A, 6B and 6C which are schematic illustrations of a cross section of the left side, right side and bottom, respectively, of an Electro Mechanical Energy Storing (EMES) mechanism with a Force Dividing (FD) system in combination with a mechanical firing mechanism and their suggested location in a firearm, the figures may represent different angles of the mechanism, according to some embodiments of the present disclosure. FIGS. 6A, 6B and 6C illustrate the combination of an EMES mechanism with a FD system, as illustrated in FIGS. 3D and 3E and detailed by mechanism 540, in a different mechanical firing mechanism then illustrated in FIGS. 4A-4C and 5A-5B, as described above. As illustrated in FIG. 6A, movable mechanical elements participating in the firing process of the firearm such as slider 604 may slide horizontally back and forth, generating mechanical energy. When slider 604 slides back e.g. to the rear of the firearm, it may for example, be cocked by sear 602. When trigger 105 is engaged, sear lever (not shown) may then move accordingly, which may result in the pivoting of sear 602. The pivoting of sear 602 may result in the releasement of slider 604, which may be pushed for example by a spring (not shown) as part of the mechanical firing mechanism, and the firing of the firearm. When slider 604 is pushed back it may slide over lever 606, which may result in cocking the EMES mechanism with a FD system as detailed below. As a result the EMES with a FD system may then, in combination with the mechanical firing mechanism, control the fire rate of the firearm as detailed below.

As illustrated in FIG. 6B, slider 604 may be pushed back towards the rear of the firearm. When pushed back, slider 604 may apply pressure on to lever 606. When lever 606 is pressed, it may press spring 608 and push pusher 612. As a result of the force applied, the forward end of pusher 612 may, for example, advance forward and pivot around pin 618. As a result of the movement of pusher 612, the pusher 612 may push trapezoid 610, forcing trapezoid 610 to move forward and rotate around pin 620. Trapezoid 610, when rotated and moved forward may for example, apply pressure on to bar 352 (illustrated in FIGS. 3D and 6C). Bar 352 may then, as a result of the pressure applied by trapezoid 610, push movable plate 331 via lever 370 and rod 354 towards magnet 332 and/or electromagnet 125 and may cause movable plate 331 to attach and/or connect to the surface of magnet 332 and/or electromagnet 125 as described above. Spring 608 may then push back, in a vertical manner, lever 606 and may also pull back pusher 612 and trapezoid 610 to their original place prior to firing.

As illustrated in FIG. 6C and described above, to control the firing rate, processor 121 may activate and/or deactivate electromagnet 125, which may release movable plate 331. When second face 342 of movable plate 331 is released from the surface of magnet 332 and/or electromagnet 125, bar 352 may be pushed backwards, e.g. toward the rear of the firearm, which may be possible due to the force applied by spring 333, for example in a releasing energy phase. When pushed backwards, bar 352 may cause sear lever 350 to pivot around pin 616, as illustrated in FIG. 6C. Upon pivoting, sear lever 350 may push sear 602, which may cause sear 602 to rotate and release slider 604, as illustrated in FIG. 6A. The releasement of slider 604 may result in the firing of the firearm.

Figure 7:
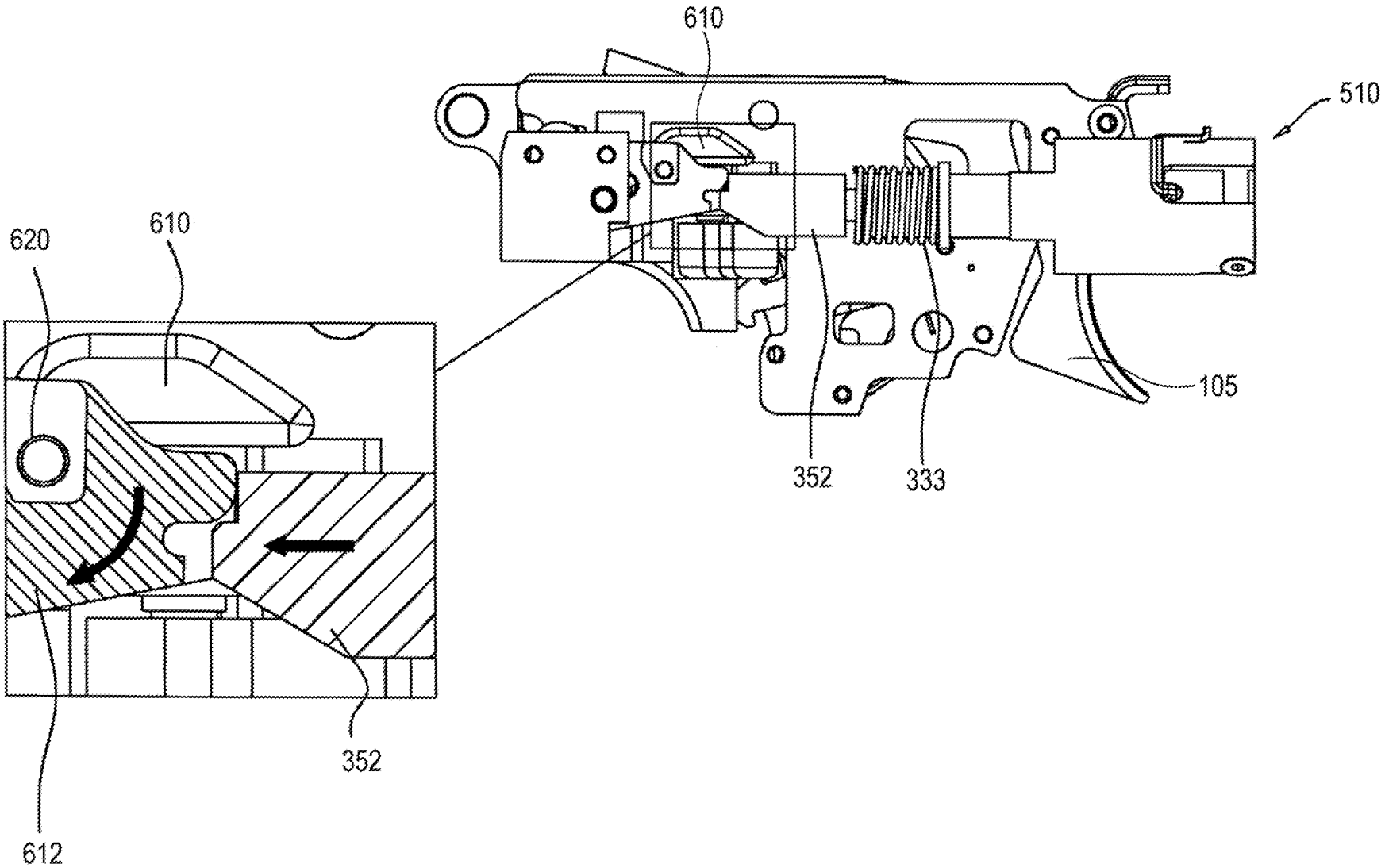
FIG. 7 is a schematic illustration of a cross-section of an Electro Mechanical Energy Storing (EMES) mechanism in combination with a mechanical firing mechanism, the illustration shows a malfunction position, according to some embodiments of the present disclosure.

Reference is now made to FIG. 7, which is a schematic illustration of a cross section of an Electro Mechanical Energy Storing (EMES) mechanism, as described above in combination with a mechanical firing mechanism representing a malfunction position, according to some embodiments of the present disclosure. FIG. 7 illustrates a malfunction of the EMES mechanism. For example when movable plate 331 is broken and/or magnet 332 and/or electromagnet 125 are not capable of holding or releasing, e.g. attracting and/or repelling, movable plate 331. For example, when bar 352 is pushed, for example by trapezoid 610 towards magnet 332 and/or electromagnet 125, and movable plate 331 may not be able to connect to magnet 332. When a malfunction occurs and second face 342 of movable plate 331 may not connect to magnet 332, bar 352 may be immediately pushed back by spring 333. The speed in which bar 352 is pushed back may be so fast that it may, for example, encounter pusher 612 and may be blocked by it. When the apparatus malfunctions, after trapezoid 610 may push bar 352 towards magnet 332 and/or electromagnet 125, it may be immediately pushed vertically by a spring (not shown) that may be wrapped around pin 620. The spring of pin 620 may be responsible for example, for pivoting trapezoid 610 as soon as bar 352 is pushed away and there is enough room for the trapezoid to move from a horizontal towards a vertical position. However, when trapezoid 610 is lifted by the spring of pin 620, a gap may be created between bar 352 and pusher 612. Since there is a malfunction of the EMES mechanism e.g. movable plate 331 may not connect to magnet 332 and/or electromagnet 125, spring 333 may immediately push back bar 352 faster than spring 608 is capable of pulling pusher 612 back to its starting position. Therefore, bar 352 may encounter pusher 612 and may apply force to pusher 612 in such a manner that would lock pusher 612 and bar 352 together, in a position that may prevent sear lever 350 from pivoting sear 602. When pusher 612 is locked by bar 352 in this position, it may not be able to push and/or rotate trapezoid 610, which then may not be able to push bar 352 forward and/or away.

The force causing sear lever 350 to pivot, originates from the complete motion range of bar 352, when pushed by spring 333. Since bar 352 may be blocked by pusher 612, it may not be able to reach the end of its stroke e.g. move its designated distance towards the rear of the firearm. Thus, bar 352 may not be able to fully push sear lever 350 to complete the pivoting of sear lever 350 around pin 616 and pivot sear 602. Therefore, by blocking bar 352 from reaching the end of its stroke, pusher 612 may prevent, via bar 352 and sear lever 350, sear 602 from pivoting and releasing slider 604, until the trigger is released and the system may be restarted. When bar 352 is blocked, it may not be able to pivot sear lever 350, which then may not be able to pivot sear 602, which may enable the releasement of slider 604. Therefore, as described above, when a malfunction of the EMES mechanism occurs, bar 352 may be blocked by pusher 612, which may prevent the malfunctioned EMES mechanism from free firing the firearm, as long as the trigger is engaged. However, when the trigger is disengaged the system may be restarted. As described above, when there is a malfunction of the EMFC apparatus the firearm may be able to fire only one round at a time when using the EMFC mode, which may be the first round fired using the mechanical firing mechanism of the firearm.

It should be noted that when the safety lever is switched to an automatic firing mode, the firearm will be able to fire at its original automatic fire rate using solely the mechanical firing mechanism.

Figure 8:
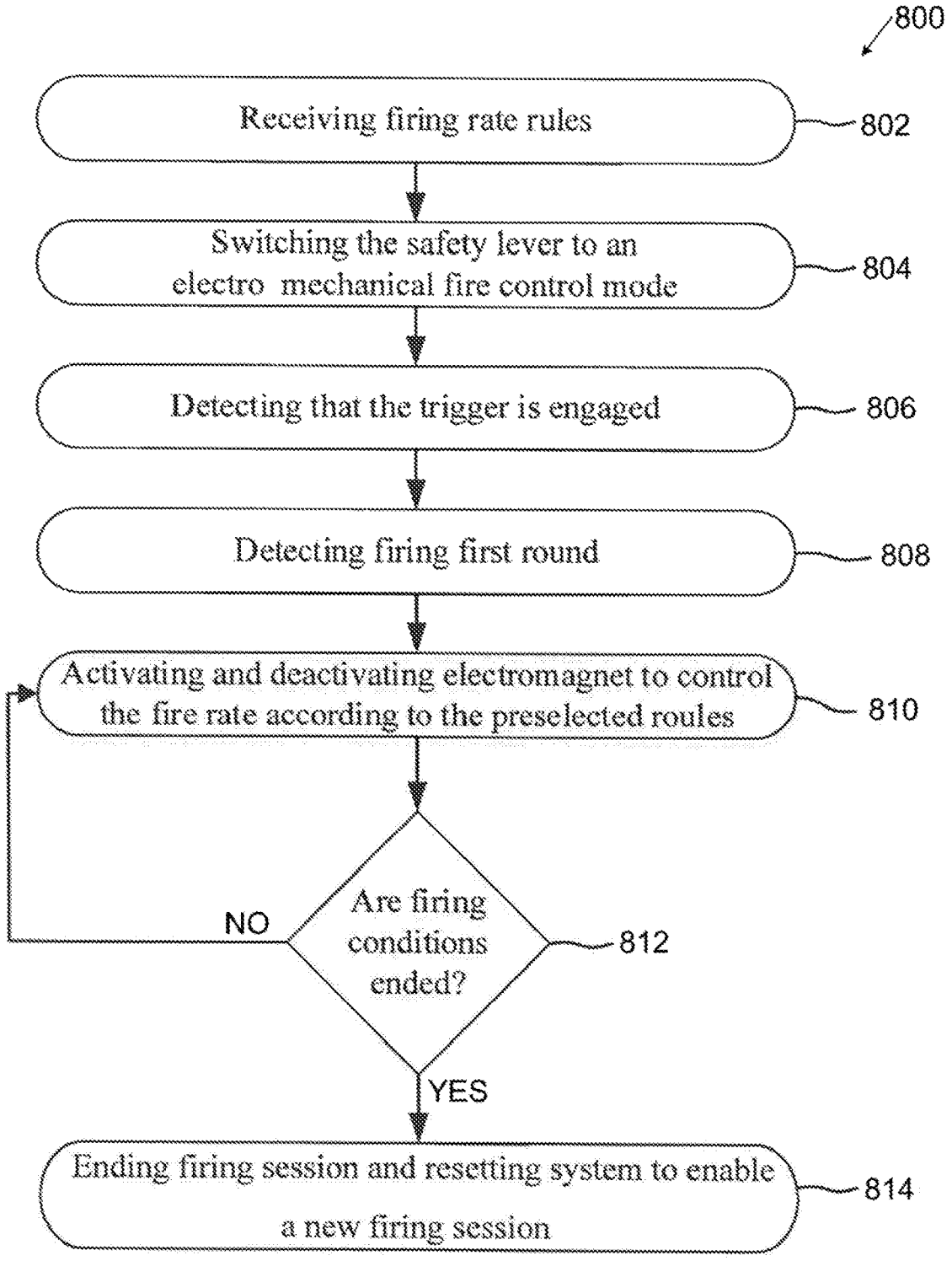
FIG. 8 is a schematic flowchart illustrating a method for controlling the fire rate of a firearm, according to some embodiments of the present disclosure.

Reference is now made to FIG. 8, which is a schematic flowchart illustrating method 800 for controlling the fire rate of a firearm, according to some embodiments of the present disclosure. As indicated in block 802, processor 121 may receive predetermined fire rate rules that may be selected by the user and applied during the firing session, for example a rule defining number of rounds fired per specific time, as long as the trigger is engaged; a rule defining firing up to a preselected number of rounds, as long as the trigger is engaged; a rule defining firing a number of rounds with preselected time gaps between them, as long as the trigger is engaged; or a combination thereof. As indicated in block 804, when switching the safety lever from a safety mode to an Electro Mechanical Fire Control mode, processor 121 may be turned on and the system may be ready to operate. It should be noted that when switching the safety lever to an Electro Mechanical Fire Control mode, there may be more than one mode of Electro Mechanical Fire Control options available for the user to choose from. Having more than one Electro Mechanical Fire Control mode to choose from, may save the user the time required to reprogram and/or send new instructions to processor 121 when operating the firearm in changing conditions, for example during combat. Turning on processor 121 only upon switching the safety lever to an EMFC mode, may save energy and may prolong the ability to operate the EMFC apparatus without the need to replace and/or recharge power source 122. For example, by replacing and/or recharging the battery and/or connecting the EMFC apparatus to an external power source. Furthermore, in order to further save energy and prolong the ability to operate the EMFC apparatus without the need to replace and/or recharge power source 122, processor 121 may go into a sleep mode. For example, going into sleep mode may take place when the safety lever is set to an EMFC mode but the trigger may not be engaged for a preselected time period.

As indicated in block 806, processor 121 may detect that trigger 105 is engaged, for example via sensor 110. Upon receiving indication from sensor 110 that the trigger was engaged, processor 121 may activate the EMFC rules that were selected. If processor 121 had gone into a sleep mode, upon receiving indication from sensor 110 that the trigger was engaged, processor 121 may exit the sleep mode and may activate the EMFC rules that were selected. As indicated in block 808, processor 121 may detect, for example using a firing sensor, that a round was fired, which may be, for example, the first round of a firing session. Upon receiving indication form the firing sensor, processor 121 may activate the EMFC rules that were selected. As indicated in block 810 once processor 121 may receive indication that the trigger is engaged, it may instruct electromagnet 125 to activate and/or deactivate, according to the preselected rule. For example, processor 121 may detect which preselected rule was chosen by the user, for example according to the mode of operation the safety lever is set to. After detecting the preselected rules, processor 121 may then activate and/or deactivate electromagnet 125 to hold or release movable plate 331 to control the fire rate. For example, according to the required RPM and/or the number of rounds fired during the firing session and/or the total number of rounds fired for a preselected time period.

As indicated in block 812, after and/or before every round fired processor 121 may check for compliance of the firing conditions and/or rules. For example a rule may me be a total of number of rounds fired while the trigger is engaged. Therefore, if the total number of rounds fired meets the number of rounds determined in the preselected rules, as long as the trigger is engaged, than processor 121 may instruct electromagnet 125 to activate and/or deactivate in order to stop firing the firearm. Another example may be that processor 121 may stop the firearm from firing after five consecutive rounds were fired according to a preselected rule. In another case, processor 121 may determine, for example, that the end of firing condition is when the firearm has deviated from a target direction and/or angle. For example, MEMs unit 130, may be used to determine a direction at which the firearm is directed. If for example, MEMs unit 130 measures that the firearm has deviated from its direction and/or angle, processor 121 may cease further firing from the firearm, until the trigger is released. In Another example, the end of firing condition may be that the trigger is no longer engaged resulting in stopping firing from the firearm, for example, a user may remove his or her finger from trigger 105. Processor 121 may receive an indication from trigger sensor 110 that the trigger is no longer in an active state, thus resulting in ending of the firing session. If the fire rate rules and conditions are met processor 121 will continue to instruct electromagnet 125 to activate and/or deactivate the electromagnet to continue firing according to the preselected rules and firing conditions. However, if the firing rules are not met, for example, the trigger is no longer engaged, then according to block 814 processor 121 may activate or deactivate electromagnet 125 in a manner that will stop the use of EMFC 100, thereby stopping the firearm from firing another round, consequently ending the firing session and resetting the system to enable it to enter a new firing session.

Figure 9:
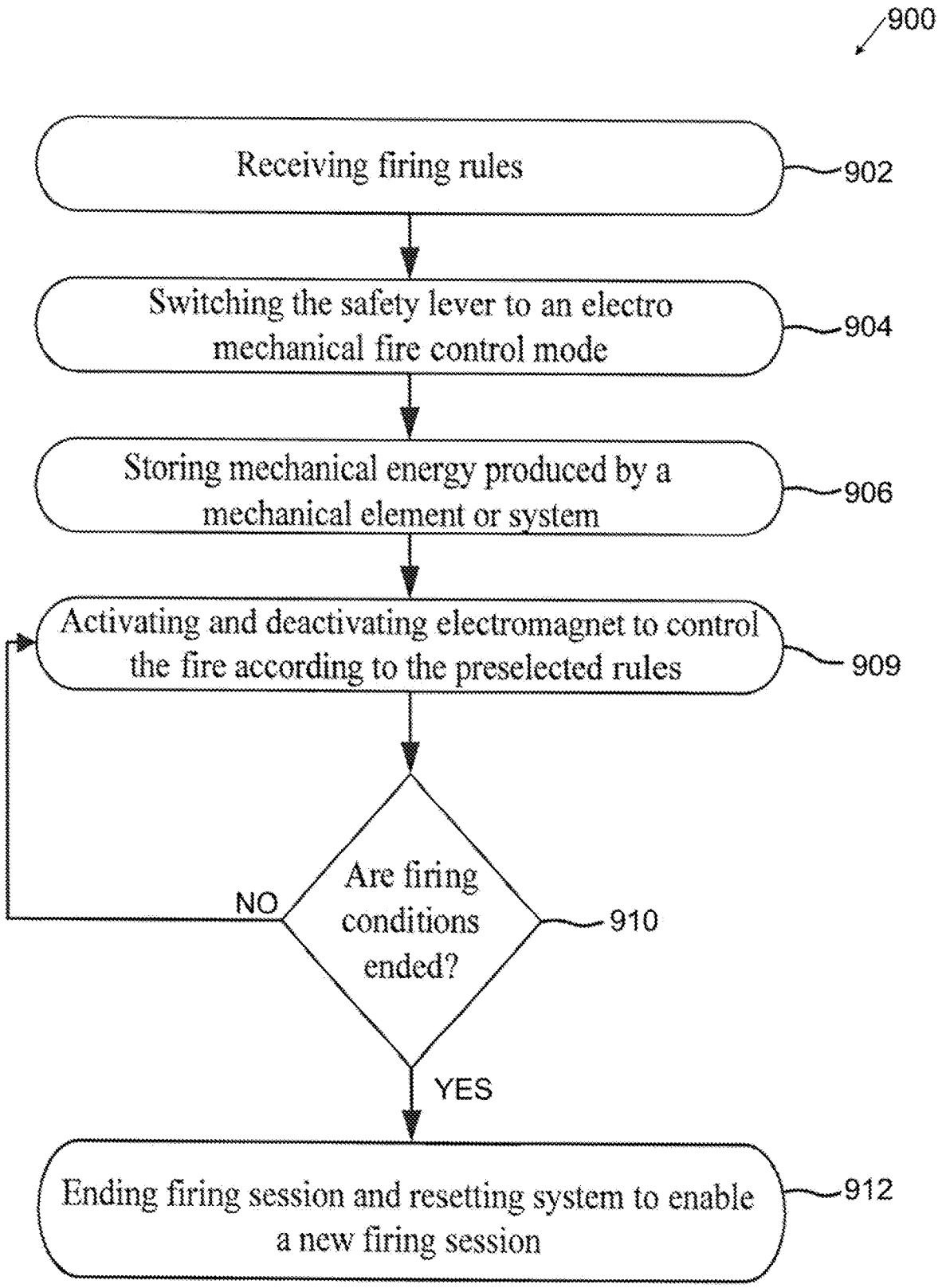
FIG. 9 is a schematic flowchart illustrating a method for controlling the fire of a firearm based on received firing rules, according to some embodiments of the present disclosure.

Reference is now made to FIG. 9, which is a schematic flowchart illustrating method 900 for controlling the fire rate of a firearm, according to some embodiments of the present disclosure. As indicated in block 902, processor 121 may receive predetermined fire rate rules that may be applied during the firing session. For example a rule defining number of rounds fired per specific time, as long as the trigger is engaged; a rule defining firing up to a preselected number of rounds, as long as the trigger is engaged; a rule defining firing a number of rounds with preselected time gaps between the rounds, whereby the time gaps may differ from one another with respect to each of the rounds, as long as the trigger is engaged; or a combination thereof. As indicated in block 904, when switching the safety lever from a safety mode to an Electro Mechanic Fire Control mode, processor 121 may be turned on and the system may be ready to operate. It should be noted that when switching the safety lever to a controlled fire mode, there may be more than one mode of Electro Mechanical Fire Control options available for the user to choose from. Having more than one EMFC mode to choose from, may save the user the time required to reprogram and/or send new instructions to processor 121 when operating the firearm in changing conditions, for example during combat. Turning on processor 121 only upon switching the safety lever to an EMFC mode, may save energy and may prolong the ability to operate the EMFC apparatus without the need to replace and/or recharge power source 122. For example, by replacing and/or recharging the battery and/or connecting the EMFC apparatus to an external power source. Furthermore, in order to further save energy and prolong the ability to operate the EMFC apparatus without the need to replace and/or recharge power source 122, processor 121 may go into a sleep mode. For example, going into sleep mode may take place when the safety lever is set to an EMFC mode but the trigger may not be engaged for a preselected time period.

As indicated in block 906, mechanical energy generated by at least one mechanical element participating in the firing processes and/or cocking of a firearm may be stored by the EMFC apparatus. When the safety lever is switched to an Electro Mechanic Fire Control mode, the EMFC apparatus may be activated, e.g. start to control the stored mechanical energy. The stored mechanical energy may be produced by a mechanical element, for example, a mechanical element participating in the firing process and/or cocking of the firearm and/or by manual operation of the firearm. In some embodiments, the apparatus may store mechanical energy, for example by using the mechanical energy generated from the previous fire round and/or manual operation of the weapon, prior to switching the safety lever to an Electro Mechanic Regulated Fire mode, i.e. block 906 may be performed prior to block 904.

As indicated in block 908, the EMFC apparatus may control the Electro Mechanical Energy Storing (EMES) mechanism. For example, the EMFS mechanism may use an electromagnet to hold and/or release the mechanical energy stored. The stored mechanical energy may be produced when, for example, firing and/or by manual operation of the firearm. Controlling the energy storing mechanism may result in activating and/or deactivating electromagnet 125. Activating and/or deactivating electromagnet 125 may enable and/or prevent the firearm from firing, which may enable the EMFC apparatus to control the fire rate. Controlling the fire rate may be subject to preselected rule. For example, processor 121 may detect which preselected rule was chosen by the user, for example according to the mode of operation the safety lever is set to. After detecting the preselected rules, processor 121 may then activate and/or deactivate electromagnet 125 to hold or release movable plate 331 to control the fire rate. For example, according to the required RPM and/or the number of rounds fired during the firing session and/or the total number of rounds fired for a preselected time period.

As indicated in block 910, after and/or before every round fired processor 121 may check for compliance of the firing conditions and/or rules. For example a rule may me be a total of number of rounds fired while the trigger is engaged. Therefore, if the total number of rounds fired meets the number of rounds determined in the preselected rules, as long as the trigger is engaged, processor 121 may instruct electromagnet 125 to activate and/or deactivate in order to stop firing the firearm. Another example may be that processor 121 may stop the firearm from firing after five consecutive rounds were fired according to a preselected rule. In another case, processor 121 may determine for example that the end of firing condition is when the firearm has deviated from a certain direction and/or angle. For example, MEMs unit 130, may be used to determine a direction at which the firearm is directed. If for example, when MEMs unit 130 measures that the firearm has deviated from a desired direction and/or angle, processor 121 may cease further firing from the firearm, until the trigger is released. In Another example, the end of firing condition may be that the trigger is no longer engaged resulting in stopping the firearm from firing, for example, a user may no longer engage trigger 105. Processor 121 may receive an indication from trigger sensor 110 that the trigger is no longer engaged, thus resulting in ending of the firing session. If the fire rate rules and conditions are met processor 121 will operate electromagnet 125 to continue firing according to the preselected rules and firing conditions. However, if the firing rules are not met, than according to block 912 processor 121 may stop the operation of electromagnet 125 in order to stop the firearm, from firing another round using the EMFC mode, and consequently ending the firing session and resetting the system to enable it to enter a new firing session.

In the context of some embodiments of the present disclosure, by way of example and without limiting, terms such as 'operating' or 'executing' imply also capabilities, such as 'operable' or 'executable', respectively.

Conjugated terms such as, by way of example, 'a thing property' implies a property of the thing, unless otherwise clearly evident from the context thereof.

The terms 'processor' or 'computer', or system thereof, are used herein as ordinary context of the art, such as a general purpose processor, or a portable device such as a smart phone or a tablet computer, or a micro-processor, or a RISC processor, or a DSP, possibly comprising additional elements such as logical circuitry, timer, memory and/or communication ports. Optionally or additionally, the terms 'processor' or 'computer' or derivatives thereof denote an apparatus that is capable of carrying out a provided or an incorporated program and/or is capable of controlling and/or accessing data storage apparatus and/or other apparatus such as input and output ports. The terms 'processor' or 'computer' denote also a plurality of processors or computers connected, and/or linked and/or otherwise communicating, possibly sharing one or more other resources such as a memory.

The terms 'software', 'program', 'software procedure' or 'procedure' or 'software code' or 'code' or 'application' may be used interchangeably according to the context thereof, and denote one or more instructions or directives or electronic circuitry for performing a sequence of operations that generally represent an algorithm and/or other process or method. The program is stored in or on a medium such as volatile or permanent memory (such as RAM or ROM), or a memory storage media (such as a disk, solid-state drive and alike), or embedded in a circuitry accessible and executable by an apparatus such as a processor or other circuitry.

The processor and program may constitute the same apparatus, at least partially, such as an array of electronic gates, such as FPGA or ASIC, designed to perform a programmed sequence of operations, optionally comprising or linked with a processor or other circuitry.

The term 'configuring' and/or 'adapting' for an objective, or a variation thereof, implies using at least a software and/or electronic circuit and/or auxiliary apparatus designed and/or implemented and/or operable or operative to achieve the objective.

A device storing and/or comprising a program and/or data constitutes an article of manufacture. Unless otherwise specified, the program and/or data are stored in or on a non-transitory medium.

In the context of this application a firearm shall include a weapon which may discharge a projectile with a variety of mechanisms including electromagnetic field, gunpowder, gas pressure, spring systems, elastic systems and alike.

In case electrical or electronic equipment is disclosed it is assumed that an appropriate power supply is used for the operation thereof.

The flowchart and block diagrams illustrate architecture, functionality or an operation of possible implementations of systems, methods and computer program products according to various embodiments of the present disclosed subject matter. In this regard, each block in the flowchart or block diagrams may represent a module, segment, or portion of program code, which comprises one or more executable instructions for implementing the specified logical function(s). It should also be noted that, in some alternative implementations, illustrated or described operations may occur in a different order or in combination or as concurrent operations instead of sequential operations to achieve the same or equivalent effect.

The corresponding structures, materials, acts, and equivalents of all means or step plus function elements in the claims below are intended to include any structure, material, or act for performing the function in combination with other claimed elements as specifically claimed. As used herein, the singular forms "a", "an" and "the" are intended to include the plural forms as well, unless the context clearly indicates otherwise. It will be further understood that the terms "comprising" "including" and/or "having" and other conjugations of these terms, when used in this specification, specify the presence of stated features, integers, steps, operations, elements, and/or components, but do not preclude the presence or addition of one or more other features, integers, steps, operations, elements, components, and/or groups thereof.

The terminology used herein should not be understood as limiting, unless otherwise specified, and is for the purpose of describing particular embodiments only and is not intended to be limiting of the disclosed subject matter. While certain embodiments of the disclosed subject matter have been illustrated and described, it will be clear that the disclosure is not limited to the embodiments described herein. Numerous modifications, changes, variations, substitutions and equivalents are not precluded.

The invention claimed is:

1. An electro mechanical fire control apparatus for controlling a firing of a firearm, the electro mechanical fire control apparatus comprising:

a Force Dividing (FD) system comprising:

at least one FD lever comprising at least a first arm and at least a second arm, said at least first arm being longer than said at least second arm wherein said at least one FD lever is configured to pivot around a first mounting point located along the at least first arm to create a fulcrum, wherein the at least one FD lever is designed to receive mechanical energy from at least one movable mechanical element during a firing of the firearm or by manual operation of the firearm;

a mechanical energy storing mechanism comprising:

a mechanical system comprising a movable plate with a first face and a second face substantially facing different directions, wherein the first face of the movable plate is designed to receive mechanical energy imparted by the at least one FD lever; and a resilient energy storing mechanism with a fixed first end and a second end, said resilient energy storing mechanism connected to the at least one FD lever; an electromagnet controllable by a control signal configured to control the resilient energy storing mechanism to hold or release the mechanical energy such to prevent or enable the firearm from firing, wherein a holding force holds the second face of the moveable plate in contact with a surface of the electromagnet; and a circuitry, including a processor, configured to generate the control signal in accordance with preselected rules for controlling the consecutive firing of the firearm with mechanical energy from a previous firing or from manual operation of the firearm, wherein the mechanical energy storing mechanism and the Force Dividing system are configured to:

(i) store the received mechanical energy by the resilient energy storing mechanism;

(ii) reduce the force applied by the resilient energy storing mechanism onto the moveable plate against the holding force, by dividing the force applied by the resilient energy storing mechanism by a ratio between a length of the at least first arm and a length of the at least second arm;

(iii) discharge the mechanical energy stored by the resilient energy storing mechanism onto a firing element in contact with the at least one FD lever by releasing the contact between the second face and the surface of the electromagnet so as to cause a consecutive firing of the firearm in response to the control signal applied to the electromagnet.

2. The electro mechanical fire control apparatus according to claim 1, wherein the structure of the electromagnet comprises a magnet.

3. The electro mechanical fire control apparatus of claim 2, wherein said electromagnet and magnet are configured to overcome the reduced force applied by the resilient energy storing mechanism in a storing energy phase, and wherein said resilient energy storing mechanism is configured to overcome the holding force of the electromagnet and magnet in a releasing energy phase.

4. The electro mechanical fire control apparatus according to claim 1, further comprising a rod connected to the first face of the movable plate, and a second resilient energy storing mechanism with a fixed first end and a second end connected to the rod, wherein the rod is designed to receive mechanical energy from the FD lever.

5. The electro mechanical fire control apparatus according to claim 4, further comprising a FD lever, wherein the FD lever is designed to (i) receive mechanical energy from at least one movable mechanical element, imparted to the FD lever during a firing of the firearm or by manual operation of the firearm and (ii) discharge the stored mechanical energy in the resilient energy storing mechanism onto a firing element in contact with the FD lever, and wherein the second resilient energy storing mechanism is designed to synchronize movement of the rod with movement of the FD lever.

6. The electro mechanical fire control apparatus according to claim 1, wherein the at least one FD lever comprises a slot, wherein the at least one pivoting point and the slot are located at different ends of the at least first arm of the FD lever.

7. The electro mechanical fire control apparatus according to claim 6, wherein the at least one FD lever pivots around an external pivoting point, located on an external pivoting axis, to create a fulcrum.

8. The electromechanical fire control apparatus according to claim 7, wherein the at least one FD lever is pivotally mounted on an element of the electro mechanical fire control apparatus or on an element of the firearm.

9. The electro mechanical fire control apparatus according to claim 6, wherein the FD lever is mounted on a mounting point on the first end of the movable plate, further wherein the FD lever slides along the slot and rotates around the mounting point.

10. The electro mechanical fire control apparatus according to claim 1, wherein the FD lever is a piston or a spring.

11. The electromechanical fire control apparatus of claim 1, wherein the apparatus is independent from the mechanical firing mechanism of the firearm, enabling the firearm to be operated normally even if the apparatus malfunctions or runs out of energy.

12. The electro mechanical fire control apparatus of claim 1, wherein the resilient energy storing mechanism and said mechanical system are in addition to a mechanical firing mechanism of the firearm.

13. The electromechanical fire control apparatus of claim 1, wherein the resilient energy storing mechanism is transferred to a cocked position upon firing the firearm or by manual operation of the firearm by at least one element, selected from a group consisting of: a sear, a bolt carrier, a slider, a hammer, a trigger and a firing pin.

14. The electro mechanical fire control apparatus of claim 1, wherein said preselected rules are selected from the group consisting of:

a rule defining number of rounds fired per specific time as long as the trigger is engaged, a rule defining firing up to a preselected number of rounds as long as the trigger is engaged, a rule defining firing a number of rounds with preselected time gaps between them as long as the trigger is engaged, and a rule defining any combination thereof.

15. The electromechanical fire control apparatus of claim 1, wherein said preselected rules comprise firing a first round upon the engagement of the trigger and firing consecutive rounds according to a command from the processor, as long as the trigger is engaged.

16. The electro mechanical fire control apparatus of claim 1, wherein said preselected rules comprise firing a first round and consecutive rounds according to a command from the processor, as long as a trigger is engaged.

17. The electro mechanical fire control apparatus of claim 1, further comprising at least one sensor configured to provide an indication that the firearm is ready to fire.

18. The electro mechanical fire control apparatus of claim 1, further comprising at least one sensor selected from a group consisting of:

a sensor configured to provide an indication that a trigger of the firearm is engaged, a sensor configured to provide an indication that a round was fired from the firearm, a sensor configured to provide an indication which state is set by the safety lever, a sensor configured to provide an indication which set of predefined rules was chosen, a sensor configured to provide an indication in which state a hammer or a sear of the mechanical firing system is set, a sensor configured to provide an indication in which state a firing pin of the mechanical firing system is set, a sensor configured to provide an indication in which state a bolt carrier assembly of the mechanical firing system is set, a sensor configured to provide an indication if the firearm is being held, a sensor configured to indicate the angle of the firearm, a sensor configured to provide an indication if a processor or another sensor is in sleep mode, a sensor configured to provide an indication of the time, a sensor configured to provide an indication of the operation time remaining when using power consumption modes or features, a sensor configured to provide an indication that the system has acquired a target or is locked on a target, a sensor configured to provide an indication of the energy storing mechanism, indicating if the system is cocked or not, and a sensor configured to provide an indication of the temperature of an element of the firearm.

19. The electromechanical fire control apparatus of claim 1, further comprising a user interface to display the preselected rules and to enable a user to input instructions into the processor.

20. The electro mechanical fire control apparatus of claim 1, further comprising a communication unit for receiving and transmitting data to configure the processor or to activate the mechanical energy storing mechanism via an external device and to transmit data to an external device.

* * * * *